US005589731A

United States Patent [19]

Fahlen et al.

[11] Patent Number: 5,589,731

[45] Date of Patent: Dec. 31, 1996

[54] INTERNAL SUPPORT STRUCTURE FOR FLAT PANEL DEVICE

[75] Inventors: Theodore S. Fahlen, San Jose; Robert M. Duboc, Jr., Menlo Park; Paul A. Lovoi, Saratoga, all of Calif.

[73] Assignee: Silicon Video Corporation, San Jose, Calif.

[21] Appl. No.: 12,542

[22] Filed: Feb. 1, 1993

Related U.S. Application Data

[63] Continuation-in-part of Ser. No. 867,044, Apr. 10, 1992, Pat. No. 5,424,605.

[51] Int. Cl.[6] ..... H01J 29/04

[52] U.S. Cl. ..... 313/495; 313/447; 313/292; 313/253; 313/256; 313/268

[58] Field of Search ..... 313/422, 495, 313/496, 497, 444, 447, 456, 460, 577, 292, 317, 309, 310, 341, 249, 252, 253, 256, 257, 258, 262, 268; 315/169.4; 345/41, 37, 50

[56] References Cited

U.S. PATENT DOCUMENTS

| | | | |
|---|---|---|---|
| 3,330,707 | 7/1967 | Reed | 156/3 |
| 3,566,187 | 2/1971 | DuBois | 315/169 |
| 3,612,944 | 10/1971 | Requa et al. | 315/12 |
| 3,622,828 | 11/1971 | Zinn | 313/103 |
| 3,753,022 | 8/1973 | Fraser, Jr. | 313/78 |
| 3,755,704 | 8/1973 | Spindt et al. | 313/309 |
| 3,789,471 | 2/1974 | Spindt et al. | 29/25.17 |
| 3,855,499 | 12/1974 | Yamada et al. | 315/169 |
| 3,935,499 | 1/1976 | Oess | 313/413 |
| 3,956,667 | 5/1976 | Veith | 315/169 |
| 4,020,381 | 4/1977 | Oess et al. | 313/351 X |
| 4,088,920 | 5/1978 | Siekanowicz et al. | 313/422 |
| 4,174,523 | 11/1979 | Marlowe et al. | 313/422 X |
| 4,227,117 | 10/1980 | Watanabe et al. | 315/13 R |
| 4,341,980 | 7/1982 | Noguchi | 315/169.1 |
| 4,435,672 | 3/1984 | Heynisch | 315/366 |
| 4,451,759 | 5/1984 | Heynisch | 313/495 |
| 4,531,122 | 7/1985 | Redfield | 340/781 |
| 4,564,790 | 1/1986 | Veith | 315/169.4 |
| 4,577,133 | 3/1986 | Wilson | 313/422 X |

(List continued on next page.)

FOREIGN PATENT DOCUMENTS

| | | |
|---|---|---|
| 436997A1 | 7/1991 | European Pat. Off. . |
| 464938A1 | 1/1992 | European Pat. Off. . |
| 496450A1 | 7/1992 | European Pat. Off. . |
| 61-224256 | 10/1986 | Japan . |

OTHER PUBLICATIONS

Knickerbocker, "Overview of the Glass–Ceramic/Copper Substrate—A High–Performance Multilayer Package for the 1990s", American Ceramic Society Bulletin, vol. 71, No. 9, Sep. 1992, pp. 1393–1401.

A. Takahashi et al. "Back Modulation Type Flat CRT", Japanese Display '92, pp. 377–380.

*Primary Examiner*—Sandra L. O'Shea
*Assistant Examiner*—Ashok Patel
*Attorney, Agent, or Firm*—Skjerven, Morrill, MacPherson, Franklin, & Friel; Ronald J. Meetin

[57] ABSTRACT

A flat panel device contains a faceplate, a backplate, a light-emitting mechanism, and a spacer. The faceplate is connected to the backplate to form a sealed enclosure. The spacer is situated within the enclosure and supports the two plates against forces acting towards the enclosure. The spacer can take various forms and can be constituted with various materials. In one embodiment, the spacer includes a spacer wall formed with multiple sheets of laminated material consisting of ceramic, glass-ceramic, ceramic reinforced glass, devitrifying glass, or metal coated with electrical insulation. In another embodiment, the spacer includes a spacer wall having a surface that follows a non-straight path adjacent the faceplate. In yet another embodiment, the spacer is a spacer structure through which a plurality of holes extends. The light-emitting mechanism is typically implemented with an electron-emitting cathode and light-emissive material situated over the faceplate. The cathode may be a thermionic cathode or a field emitter cathode.

74 Claims, 26 Drawing Sheets

U.S. PATENT DOCUMENTS

| | | | |
|---|---|---|---|
| 4,618,801 | 10/1986 | Kakino | 313/495 |
| 4,622,492 | 11/1986 | Barker | 313/422 |
| 4,677,259 | 6/1987 | Abe | 178/18 |
| 4,719,388 | 1/1988 | Oess | 315/169.1 |
| 4,728,851 | 3/1988 | Lambe | 313/309 |
| 4,820,661 | 4/1989 | Nair | 501/79 |
| 4,857,799 | 8/1989 | Spindt et al. | 313/495 |
| 4,867,935 | 9/1989 | Morrison, Jr. | 264/61 |
| 4,874,981 | 10/1989 | Spindt | 313/309 |
| 4,884,010 | 11/1989 | Biberian | 315/366 |
| 4,887,000 | 12/1989 | Yamazaki et al. | 313/422 |
| 4,900,981 | 2/1990 | Yamazaki et al. | 313/422 |
| 4,904,895 | 2/1990 | Tsukamoto et al. | 313/336 |
| 4,908,539 | 3/1990 | Meyer | 315/169.3 |
| 4,923,421 | 5/1990 | Brodie et al. . | |
| 4,940,916 | 7/1990 | Borel et al. | 313/306 |
| 4,948,759 | 8/1990 | Nair | 501/17 |
| 4,954,744 | 9/1990 | Suzuki et al. | 313/336 |
| 4,956,574 | 9/1990 | Kane | 313/306 |
| 4,964,946 | 10/1990 | Gray et al. | 156/643 |
| 4,994,708 | 2/1991 | Shimizu et al. | 313/306 |
| 5,003,219 | 3/1991 | Maragishi et al. | 313/422 X |
| 5,015,912 | 5/1991 | Spindt et al. | 313/495 |
| 5,053,673 | 10/1991 | Tomii et al. | 313/308 |
| 5,057,047 | 10/1991 | Greene et al. | 445/24 |
| 5,063,327 | 11/1991 | Brodie et al. | 313/351 X |
| 5,070,282 | 12/1991 | Epsztein | 315/383 |
| 5,130,614 | 7/1992 | Staelin | 315/366 |
| 5,155,410 | 10/1992 | Wakasano et al. . | |
| 5,160,871 | 11/1992 | Tomii et al. | 313/422 X |
| 5,227,691 | 7/1993 | Murai et al. | 313/497 X |
| 5,229,691 | 7/1993 | Shichao et al. | 313/422 X |
| 5,313,136 | 5/1994 | Van Gorkom et al. . | |

BLANK GLASS CERAMIC TAPE
90
18
90
92

FABRI-CATE VIA HOLES
18

SCREEN PRINT VIA FILLING COND-UCTORS
94

SCREEN PRINT COND-UCTIVE TRACES
90
96
96
96

FABRI-CATE HOLES FOR PIXELS
90
96
96

STACK LAYERS AND LAMIN-ATE
90x
96
96a
96b
96c
90a
90b
90c
90d
90e

CLEAR HOLES WITH ABRA-SIVE FLUID
44
90x

PROFILE FIRING
90x

APPLY AND PRE-GLAZE SOLDER GLASS (BOTH SIDES)
98
90x

INTERNAL SUPPORT STRUCTURE FOR FLAT PANEL DEVICE

CROSS-REFERENCE TO RELATED APPLICATIONS

This application is a continuation-in-part of U.S. patent application Ser. No. 07/867,044, filed Apr. 10, 1992, now U.S. Pat. No. 5,424,605 entitled "Self Supporting Flat Video Display". This application is related to co-filed U.S. patent application Ser. No. 08/012,297, entitled "Grid Addressed Field Emission Cathode" by Robert M. Duboc, Jr. and Paul A. Lovoi.

BACKGROUND OF THE INVENTION

1. Field of the Invention

This invention relates to flat panel devices such as a flat cathode ray tube. More particularly, this invention relates to a support structure for supporting a faceplate and backplate of a flat panel device against the force arising from the differential pressure between a vacuum pressure within the flat panel device and the external atmospheric pressure.

2. Related Art

Numerous attempts have been made in recent years to construct a flat cathode ray tube (CRT) display (also known as a "flat panel display") to replace the conventional CRT display in order to provide a lighter and less bulky display. In addition to flat CRT displays, other flat panel displays, such as plasma displays, have also been developed.

In flat panel displays, a faceplate, a backplate, and connecting walls around the periphery of the faceplate and backplate form an enclosure. In some flat panel displays, the enclosure is held at vacuum pressure, e.g., in flat CRT displays, approximately $1\times10^{-7}$ torr. The interior surface of the faceplate is coated with phosphor or phosphor patterns which defines the active region of the display. Cathodes located adjacent the backplate are excited to release electrons which are accelerated toward the phosphor on the faceplate. When the phosphor is struck by electrons, the phosphor emits light which is seen by a viewer at the exterior surface of the faceplate (the "viewing surface").

A force is exerted on the walls of the flat panel display due to the differential pressure between the internal vacuum pressure and the external atmospheric pressure that, left unopposed, can make the flat panel display collapse. In rectangular displays having greater than an approximately 1 inch diagonal (the diagonal is the distance between opposite corners of the active region), the faceplate and backplate are particularly susceptible to this type of mechanical failure due to their high aspect ratio (here, either the width or the height divided by the thickness).

One way to increase the resistance of the faceplate and/or backplate to collapse is to form the faceplate and/or backplate in an arced shape to increase the ability of the faceplate and/or backplate to carry the applied load. However, such arcing makes the overall display undesirably thick.

Another way to increase the resistance of the faceplate and/or backplate to collapse is to make the faceplate and/or backplate relatively thick. However, this is undesirable because of the added weight and bulk attendant the increased thickness, and because of contrast and resolution problems, such as increased spot-halo and light-spreading problems, due to internal reflections within the thick faceplate.

Since the faceplate and backplate comprise a significant fraction of the total volume of material required to make a flat panel display, it is desirable to use thin, lightweight material for both the faceplate and backplate. Thus, there is a need for a flat panel display having a means of supporting a thin, lightweight faceplate and backplate against the pressure differential existing across the faceplate and backplate.

Spacers have been used to support the faceplate and/or backplate. Previous spacers have been walls or posts located between pixels (phosphor regions that define the smallest individual picture element) in the active region of the display. However, the presence of the spacers may adversely affect the flow of electrons toward the faceplate. Additionally, the spacers must be constructed so that they are not visible on the external viewing surface of the display.

Previously, spacers have been formed by photopatterning polyimide. However, for large aspect ratios (here, the length of the spacer, in a direction perpendicular to the faceplate and backplate, divided by the thickness of the spacer), e.g., greater than 4:1, photopatterned polyimide spacers are not sufficiently strong to withstand the loads applied and are susceptible to buckling or deforming. Since the aspect ratio of photopatterned polyimide spacers must be relatively small, in flat panel displays using such spacers, the spacing between backplate and faceplate is reduced, requiring that low voltage (i.e., less efficient) phosphor be used on the faceplate.

Additionally, polyimide has a coefficient of thermal expansion that cannot be adequately matched to the coefficient of thermal expansion of the materials typically used for the faceplate, backplate and addressing grid, i.e., glass for the faceplate, glass, ceramic, glass-ceramic or metal for the backplate, and glass-ceramic or ceramic for the addressing grid. Therefore, heating that occurs during assembly of the flat panel display, as well as heating that may occur during use of the flat panel display, can cause a different amount of expansion and contraction of the spacers, relative to the addressing grid, faceplate and/or backplate, that results in registration problems between the spacers and the addressing grid, faceplate and/or backplate, or damage to the faceplate or backplate.

Finally, when used in a vacuum pressure environment, such as is present within a flat panel display, polyimide spacers may be susceptible to outgassing as a result of electrons colliding with the spacers.

Spacers have also been made of glass. However, glass may not be as strong as desired. Further, micro-cracks that are inherent in glass make glass spacers even weaker than "ideal" glass because of the tendency of micro-cracks to propagate easily throughout glass.

SUMMARY OF THE INVENTION

According to the invention, a flat panel device is provided including a spacer for providing internal support against the force arising from the differential pressure between the vacuum pressure (i.e., any pressure less than atmospheric pressure) within the flat panel device and the external atmospheric pressure.

In one embodiment of the invention, the flat panel device includes a faceplate and backplate which form a sealed enclosure within which the spacer is disposed. The spacer is made of ceramic and can be a spacer wall, a spacer structure, or some combination of a spacer wall, spacer walls, and spacer structure.

The flat panel device includes a means to emit light. In alternative embodiments of the invention, the flat panel device includes a thermionic cathode or a field emitter cathode.

The faceplate and backplate of the flat panel device can both be straight or both be curved.

The flat panel device can include an addressing grid. An anode spacer is formed between the addressing grid and faceplate, and a cathode spacer is formed between the addressing grid and backplate. Each of the anode and cathode spacer can be a spacer wall, a spacer structure, or some combination of a spacer wall, spacer walls, and spacer structure.

In another embodiment of the invention, the flat panel device includes a faceplate and backplate which form a sealed enclosure within which a spacer structure is disposed.

The flat panel device according to this embodiment can include either a thermionic cathode or a field emitter cathode, and the faceplate and backplate of the flat panel device can both be straight or both be curved.

Again, the flat panel device can include an addressing grid on either side of which is formed an anode spacer and cathode spacer, respectively. Each of the anode and cathode spacer can be a spacer wall, a spacer structure, or some combination of a spacer wall, spacer walls, and spacer structure.

In another embodiment of the invention, rather than including a faceplate and backplate, the flat panel device includes two faceplates which form a sealed enclosure within which a ceramic spacer is disposed. Again, either a thermionic or field emitter cathode can be used.

The flat panel device according to this embodiment of the invention can include a first and second addressing grid. A cathode spacer can be formed between the first and second addressing grid and an anode spacer can be formed between each of the faceplates and a corresponding addressing grid. Each of the anode and cathode spacers can be a spacer wall, a spacer structure, or some combination of a spacer wall, spacer walls, and spacer structure.

The invention also includes a method for assembling a flat panel device in which a ceramic or glass-ceramic spacer is mounted between a backplate and faceplate, and the backplate and faceplate are sealed to encase the spacer in an enclosure. The spacer can be a spacer wall or spacer structure.

An addressing grid can also be mounted within the enclosure. To hold spacer walls in proper alignment during assembly, the addressing grid and/or a top or bottom wall of the enclosure can be notched, or alignment pins or a notched alignment bar can be attached to the addressing grid.

The spacer structure can be formed by attaching sheets of ceramic or glass-ceramic material together and drilling holes in each of the sheets. The holes can be drilled in each sheet individually, in groups of sheets attached together, or at one time through all of the sheets after they have been attached together.

Spacers according to the invention can be easily fabricated using standard techniques for forming and assembling ceramic or glass-ceramic tape. Additionally, spacers made of ceramic or glass-ceramic tape can have the same coefficient of thermal expansion as the material used for the faceplate and backplate of the flat panel device. Consequently, proper registration can be maintained between spacers and the other components of the flat panel device when the flat panel device undergoes heating. Further, ceramic or glass-ceramic provide stronger spacers than possible if polyimide or glass is used.

BRIEF DESCRIPTION OF THE DRAWINGS

FIG. 2A is a cross-sectional view taken along line B—B of FIG. 2B, and FIG. 2B is a cross-sectional view taken along line A—A of FIG. 2A.

DETAILED DESCRIPTION OF EMBODIMENTS OF THE INVENTION

In the following description of embodiments of the invention, the embodiments are described with respect to a flat CRT display. It is to be understood that the invention is also applicable to other flat panel displays such as plasma displays or vacuum fluorescent displays. Further, the invention is not limited to use with displays, but can be used with other flat panel devices used for other purposes such as optical signal processing, optical addressing for use in controlling other devices such as, for instance, phased array radar devices, or scanning of an image to be reproduced on another medium such as in copiers or printers.

Figure 1:
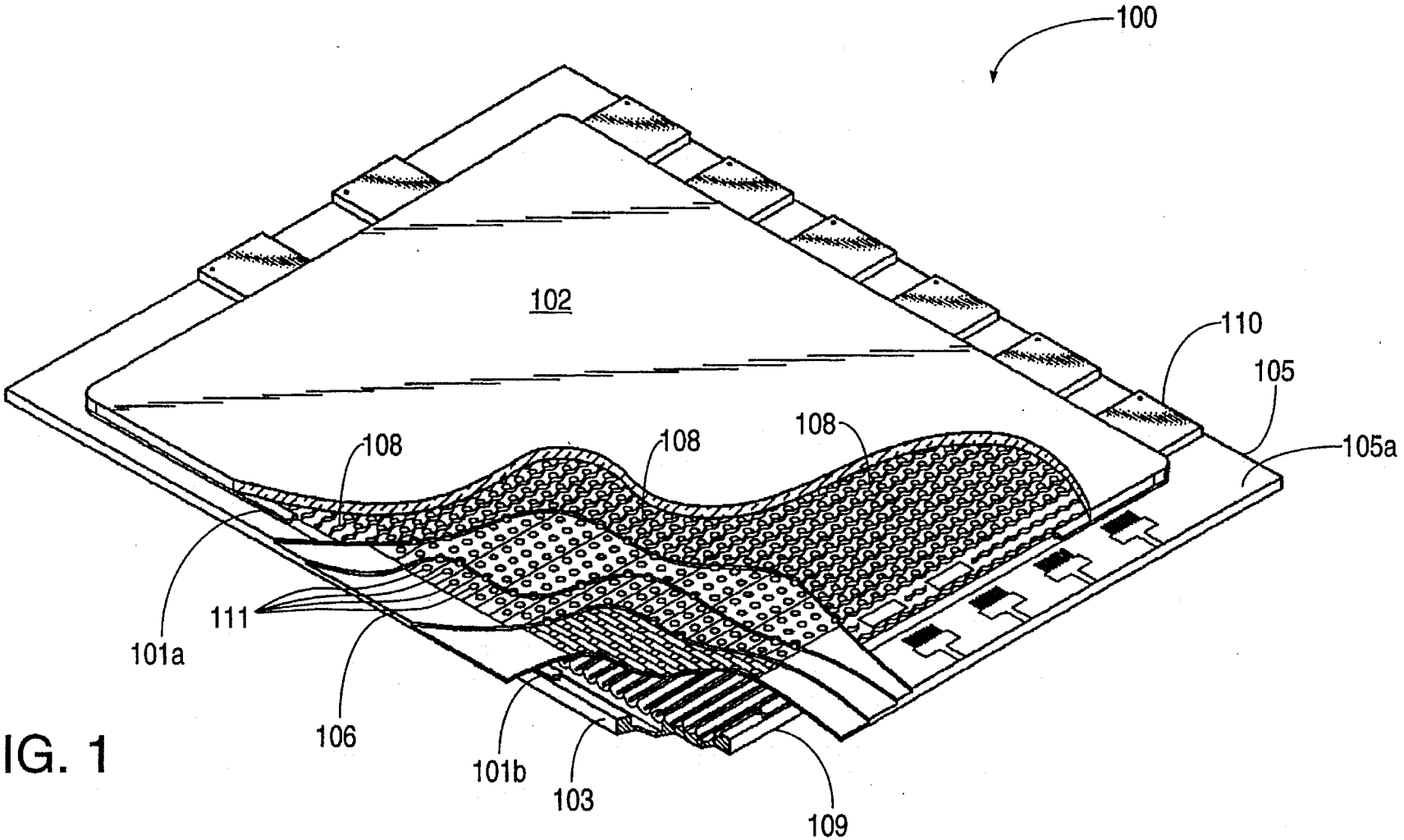
FIG. 1 is a perspective cutaway view of a flat panel device according to an embodiment of the invention.

FIG. 1 is a perspective cutaway view of flat panel display 100. Herein, a flat panel display is a display in which the faceplate and backplate are substantially parallel, and the thickness of the display is small compared to the thickness of a typical CRT display, the thickness of the display being measured in a direction substantially perpendicular to the faceplate and backplate. Typically, though not necessarily, the thickness of a flat panel display is less than 2 inches (5.08 cm). Often, the thickness of a flat panel display is substantially less than 2 inches, e.g., 0.25–1.0 inches (0.64–2.54 cm).

Flat panel display 100 includes faceplate 102, backplate 103 and layer 105 having peripheral region 105*a*, outside seals 101*a*, 101*b*, on which are electronics 110 are disposed. Faceplate 102, backplate 103 and seals 101*a*, 101*b* form an enclosure that is held at vacuum pressure (herein, vacuum pressure is defined as any pressure less than atmospheric pressure) of approximately $1\times10^{-7}$ torr. Within the enclosure, electrons are emitted from cathode 109 toward the phosphor coated interior surface of faceplate 102 (i.e., anode). Electronics 110 includes driving circuitry for controlling the voltage of electrodes in holes 111 of addressing grid 106 located between cathode 109 and faceplate 102 so that the flow of electrons to faceplate 102 is regulated. Spacers 108 support faceplate 102 against addressing grid 106.

Figure 2B:
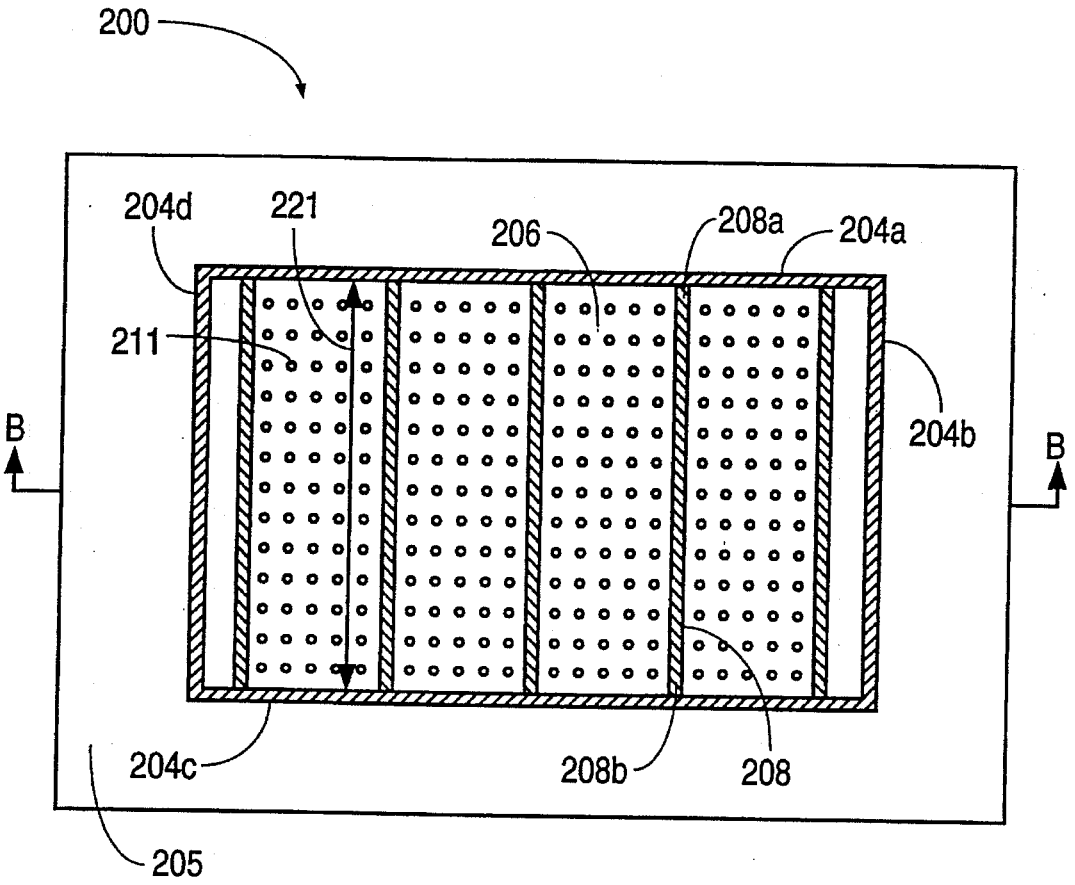
FIGS. 2A and 2B are simplified cross-sectional views of a flat panel device according to an embodiment of the invention.
Figure 2A:
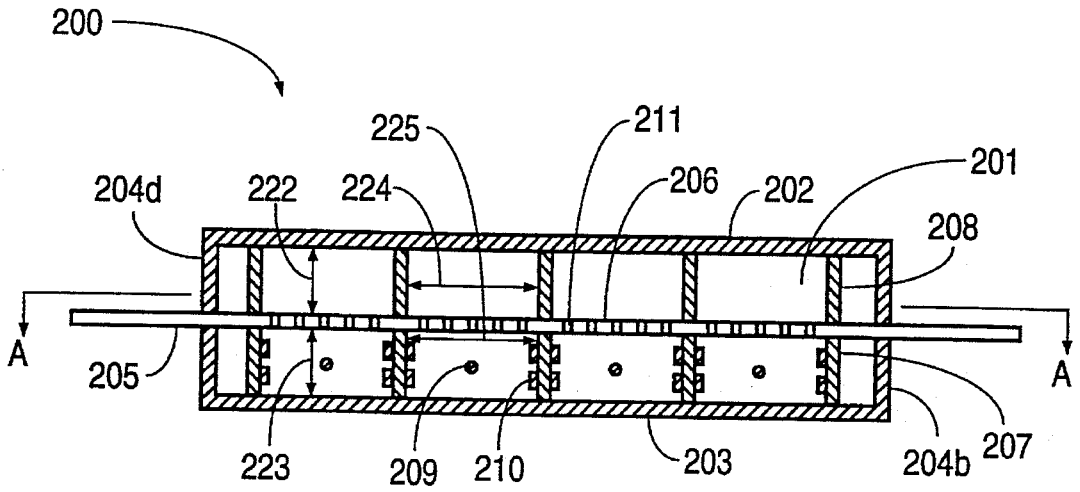

FIG. 2A is a simplified cross-sectional view, taken along line B—B of FIG. 2B, of flat panel display 200 according to the invention. FIG. 2B is a simplified cross-sectional view, taken along line A—A of FIG. 2A, of flat panel display 200. Faceplate 202, backplate 203, top wall 204*a*, bottom wall 204*c*, and side walls 204*b*, 204*d* form enclosure 201 that is held at vacuum pressure. The side (interior side) of faceplate 202 facing into enclosure 201 is coated with phosphor or phosphor patterns. Layer 205 is disposed between faceplate 202 and backplate 203. Addressing grid 206 is formed on the portion of layer 205 corresponding to the active region (i.e., projected area of the phosphor coated region of faceplate 202 on a plane parallel to faceplate 202) of faceplate 202. Spacer walls 207 (cathode spacer walls) and 208 (anode spacer walls) are disposed between backplate 203 and addressing grid 206, and faceplate 202 and addressing grid 206, respectively.

Herein, "spacer" is used to describe generally any structure used as an internal support within a flat panel display. In this disclosure, specific embodiments of spacers according to the invention are described as "spacer walls" and a "spacer structure." "Spacer" subsumes both "spacer walls" and "spacer structure," as well as any other structures performing the above-noted function.

A thermionic cathode is located between addressing grid 206 and backplate 203. The thermionic cathode includes cathode wires 209, and directional electrodes 210 formed on cathode spacer walls 207. Though two directional electrodes 210 are shown formed on each side of a cathode spacer walls 207, it is to be understood that other numbers of directional electrodes 210 could be used. Though not shown, electrodes could also be formed on backplate 203. The ends of each cathode wire 209 are attached to a spring by, for instance, welding. The springs are attached to backplate 203, addressing grid 206 or cathode spacer walls 207. The springs keep cathode wires 209 straight as they heat and expand during operation of display 200, then cool and contract when display 200 is turned off.

In FIG. 2A, one cathode wire 209 is shown between each cathode spacer wall 207. It is to be understood that there can be more than one cathode wire 209 between each cathode spacer wall 207.

Though a thermionic cathode in which a wire is heated to emit electrons is described above, it is to be understood that in embodiments of the invention including a thermionic cathode, other types of thermionic cathode could be used. For instance, rather than including a wire, a thermionic cathode (microthermionic cathode) can include dots (the dots can be of any shape) of material formed on backplate 203 which are heated to emit electrons.

Cathode wire 209 is heated to release electrons. A voltage may be applied to directional electrodes 210 to help shape the electron distribution and electron paths as the electrons move toward addressing grid 206. Voltages applied to electrodes (not shown) formed on the surface of holes 211 formed in addressing grid 206 govern whether the electrons pass through addressing grid 206 to strike the phosphor coated on faceplate 202. Addressing grid 206 may also contain electrodes that direct the electrons to strike a particular phosphor region or regions, and electrodes that focus the electron distribution.

Faceplate 202 is made of glass. Backplate 203 can be made of glass, ceramic, glass-ceramic or metal. Addressing grid 206 is made of ceramic or glass-ceramic. Walls 204*a*, 204*b*, 204*c*, 204*d* are made of ceramic, glass-ceramic or metal.

Illustratively, the thickness of faceplate 202 is approximately 0.080 inches (2.03 mm), the thickness of addressing grid 206 is approximately 0.020 inches (0.51 mm), and the thickness of backplate 203 is approximately 0.080 inches (2.03 mm).

Distance 222 between the phosphor coated interior surface of faceplate 202 and the facing surface of addressing grid 206 depends upon voltage breakdown requirements. In one embodiment, distance 222 is approximately 0.100 inches (2.54 mm). Distance 223 between the interior surface of backplate 203 and the facing surface of addressing grid 206 depends upon the uniformity of the electron flow from the cathode. In one embodiment, distance 223 is approximately 0.250 inches (6.4 mm).

An important aspect of the invention is that, because of the support provided by spacer walls 207, 208, the above illustrative dimensions are appropriate for flat panel displays having a diagonal (i.e., the diagonal distance between opposite corners of the active area) of any size.

Spacing 225 of cathode spacer walls 207 is determined according to mechanical and electrical constraints. Mechanically, there must be an adequate number of cathode spacer walls 207, positioned properly with respect to addressing grid 206 to properly support backplate 203 against the pressure differential between the vacuum pressure in enclosure 201 and the ambient pressure surrounding the exterior of flat panel display 200. Spacing 225 is related to the distance 223 between the interior surface of backplate 203 and the facing surface of addressing grid 206, the material of which cathode spacer walls 207 are made, and the thickness and material of backplate 203.

Electrically, cathode spacer walls 207 must be located so that directional electrodes 210 are an appropriate distance from cathode wire 209 to achieve the desired distribution and path-shape of electrons emitted from cathode wire 209, and to ensure that the electrons are accelerated adequately toward addressing grid 206. Depending on the particular electrical and geometrical characteristics of flat display 200, either electrical or mechanical constraints may dictate the maximum allowable spacing 225.

In addition to the above constraints, cathode spacer walls 207 must be located so that they do not cover holes 211 formed in addressing grid 206, or adversely intercept or deflect electrons.

Spacing 224 of anode spacer walls 208 is also determined according to mechanical and electrical considerations. Mechanically, there must be an adequate number of anode spacer walls 208, positioned properly with respect to addressing grid 206 to properly support faceplate 202 against the pressure differential between the vacuum pressure in enclosure 201 and the ambient pressure surrounding the exterior of flat panel display 200. Similarly to spacing 225, spacing 224 is related to the distance 222 between the interior surface of faceplate 202 and the facing surface of addressing grid 206, the material of which anode spacer walls 208 are made, and the thickness of faceplate 202.

Further, anode spacer walls 208 must be located so that they do not cover holes 211 formed in addressing grid 206, cover phosphor on faceplate 202, or adversely intercept or deflect electrons.

In one embodiment of the invention, for glass faceplate 202 having a thickness of 0.080 inches (2.03 mm), glass-ceramic anode spacer walls 208 having a thickness of 4 mils (0.102 mm), and distance 222 of 0.1 inches (2.54 mm), the spacing 224 is approximately 1 inch (2.54 cm). For glass backplate 203 having a thickness of 0.080 inches (2.03 mm), glass-ceramic cathode spacer walls 207 having a thickness of 4 mils (0.102 mm), and distance 223 of 0.25 inches (6.4 mm), the spacing 225 is also approximately 1 inch (2.54 cm), taking into consideration only mechanical constraints on spacing 225. However, the maximum spacing 225 of cathode spacer walls 207 may vary from this value because cathode spacer walls 207 can be shaped, as described below, and because backplate 203 can be made of a material other than glass. Further, as noted above, electrical considerations may dictate a different spacing 225.

Figure 3B:
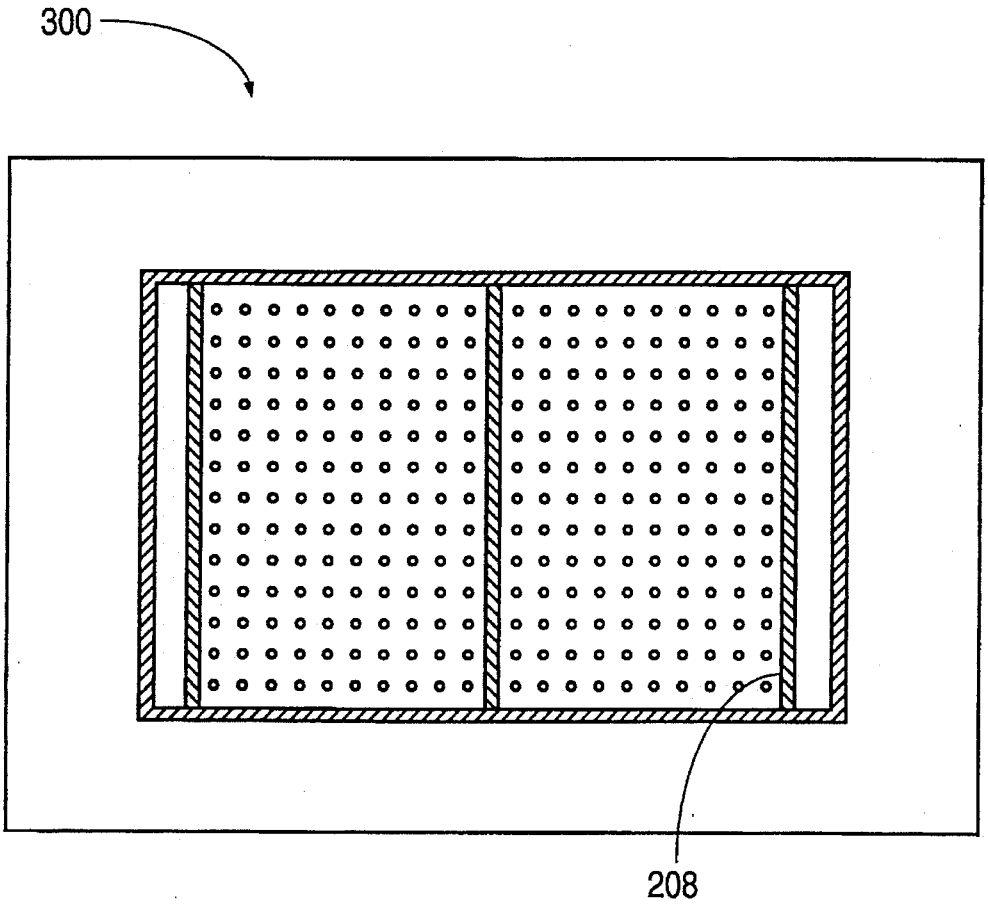
FIGS. 3A and 3B are cross-sectional views, similar to FIGS. 2A and 2B, of a flat panel device according to an embodiment of the invention having matched and unmatched cathode spacers.
Figure 3A:
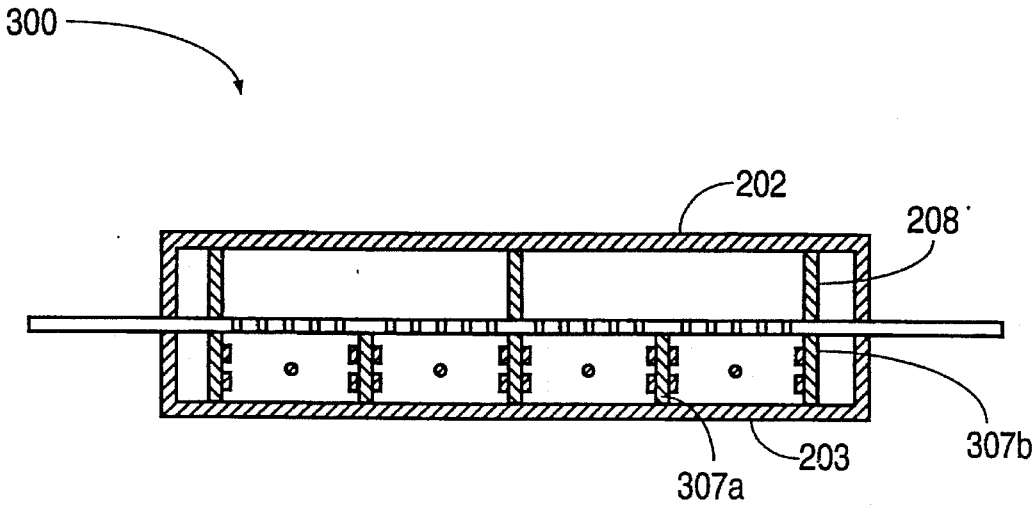

Anode spacer walls 208 can be located such that anode spacer walls 208 are opposite addressing grid 206 from one of cathode spacer walls 207. Anode spacer walls 208 need not be formed opposite each cathode spacer wall 207 if the backplate 203 is sufficiently thick. Further cathode spacer walls 207 need not be formed opposite each anode spacer wall 208. FIGS. 3A and 3B are cross-sectional views, similar to FIGS. 2A and 2B, of flat panel display 300 having both "unmatched" cathode spacer walls **307*a* (i.e., cathode spacer walls not having an anode spacer wall opposite addressing grid 206) and "matched" cathode spacer walls 307*b* (i.e., cathode spacer walls having an anode spacer wall opposite addressing grid 206**).

Figure 3D:
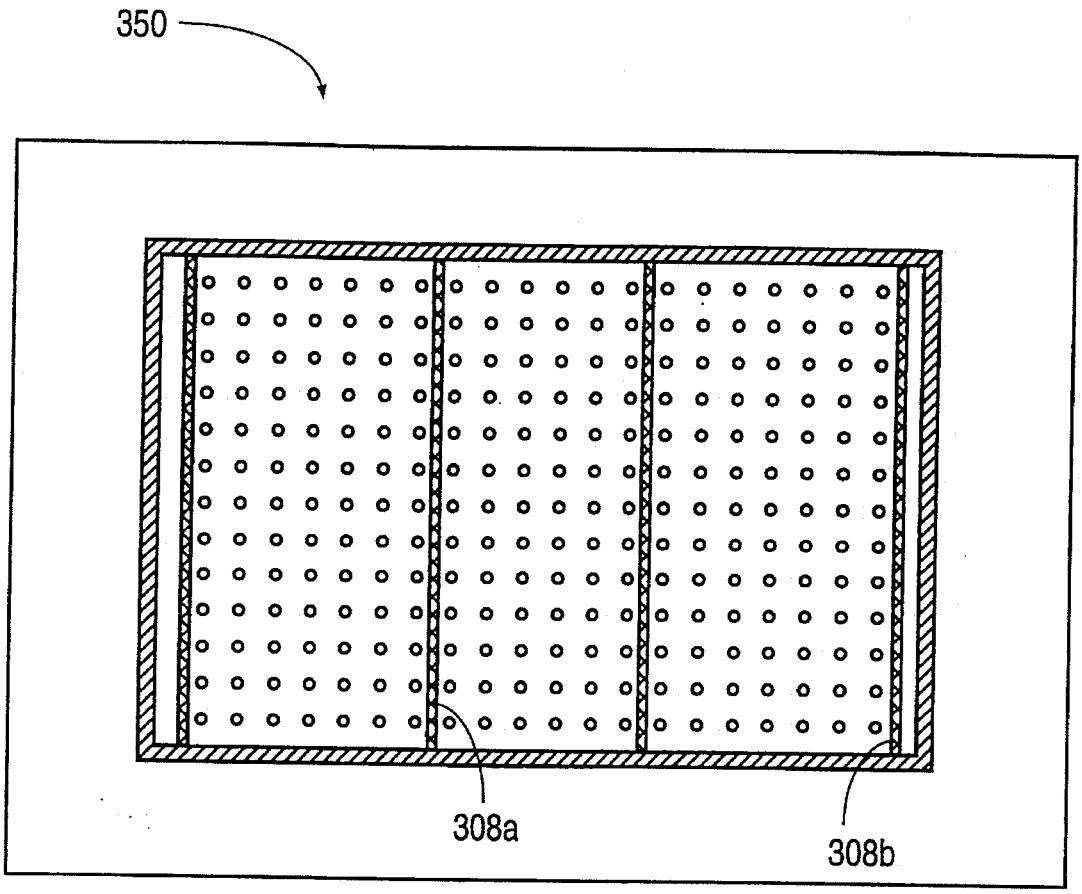
FIGS. 3C and 3D are cross-sectional views, similar to FIGS. 2A and 2B, of a flat panel device according to an embodiment of the invention having matched and unmatched anode spacers as well as matched and unmatched cathode spacers.
Figure 3C:
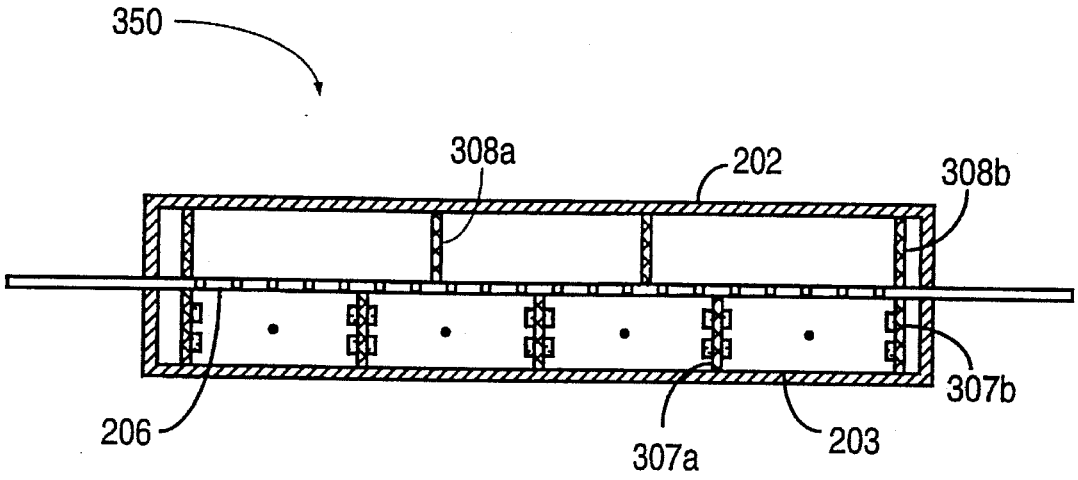

FIGS. 3C and 3D are further cross-sectional views, likewise similar to FIGS. 2A and 2B, of flat panel display 350 having both unmatched cathode spacer walls **307*a* and matched cathode spacer walls 307*b*. In FIGS. 3C and 3D, display 350 also has unmatched anode spacer walls 308*a* (i.e., anode spacer walls not having a cathode spacer wall opposite grid 206) and matched anode spacer walls 308*b* (i.e., anode spacer walls having a cathode spacer wall opposite grid 206**).

Figure 4:
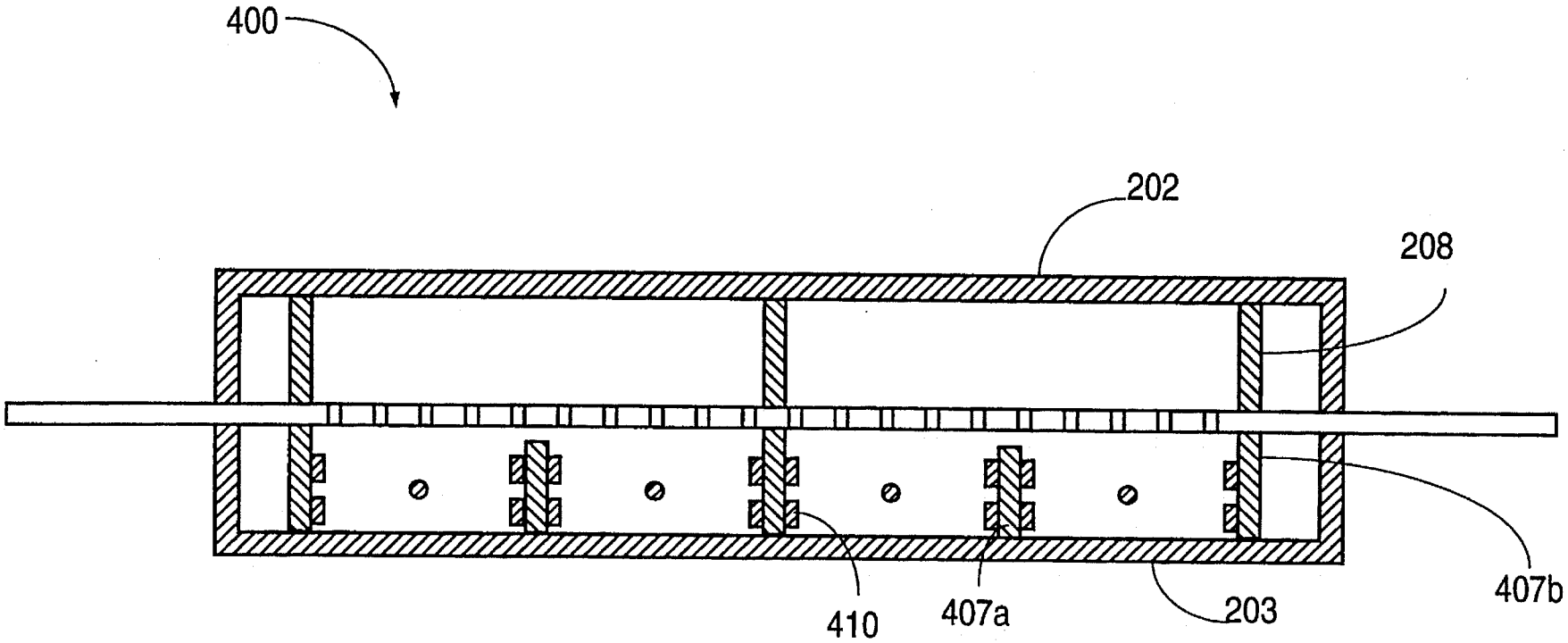
FIG. 4 is a cross-sectional view, similar to the cross-sectional view of FIG. 2A, in which some cathode spacers do not extend all the way to the addressing grid while other cathode spacers do extend all the way to the addressing grid.

In the embodiments discussed so far, cathode spacer walls, e.g., cathode spacer walls 207, have extended all the way from backplate 203 to addressing grid 206. This need not be the case for all cathode spacer walls. FIG. 4 is a cross-sectional view, similar to the cross-sectional view of FIG. 2A, in which cathode spacer walls **407*a* do not extend all the way to addressing grid 206 while cathode spacer walls 407*b* do extend all the way to addressing grid 206. Cathode spacer walls 407*b* provide support between backplate 203 and addressing grid 206, and support directional electrodes 410. Cathode spacer walls 407*a* only support directional electrodes 410; cathode spacer walls 407*a* do not provide support between backplate 203 and addressing grid 206. Although it may be desirable to have cathode spacer walls 407*b* located opposite anode spacer walls 208, it is not a requirement. Further cathode spacer walls 407*a*** must be located so as to provide the desired electron flow from the cathode wires.

Spacer walls 207, 208 must have a sufficiently small thickness so that spacer walls 207, 208 do not overlap holes 211. In one embodiment of the invention, holes 211 are approximately 5 mils (0.127 mm) in diameter and have a center-to-center distance, measured between holes 211 in the same row or column, of 12.5 mils (0.318 mm). Spacer walls 207, 208 have a thickness of approximately 4 mils (0.102 mm).

Generally, spacer walls and spacer structures in embodiments of the invention described above and below, e.g., spacer walls 207, 208, are made of a thin material which is readily workable in an untreated state and becomes stiff and strong after a prescribed treatment. The material must also be compatible with use in a vacuum environment. Further, an important aspect of the invention is that the spacer walls and spacer structures are made of a material having a coefficient of thermal expansion that closely matches the coefficients of thermal expansion of the faceplate, backplate and addressing grid (if present), e.g., faceplate 202, backplate 203, addressing grid 206. Matching of the coefficients of thermal expansion means that spacer walls 207, 208, addressing grid 206, faceplate 202 and backplate 203 expand and contract approximately the same amount during heating that occurs when flat panel display 200 is assembled or operated. Consequently, proper alignment is maintained among spacer walls 207, 208, addressing grid 206, faceplate 202 and backplate 203. Possible consequences of not having matching coefficients of thermal expansion are: damage to the phosphor resulting from movement of anode spacer walls 208 relative to faceplate 202, stresses within flat panel display 200 that might cause parts of flat panel display 200 to fail (including failure of flat panel display 200 vacuum integrity), or failure of the anode or cathode support walls. Another important aspect of the invention is that the spacer walls and spacer structures can be made of the same material used to form the addressing grid (if present).

In one embodiment, spacer walls 207, 208 are made of a ceramic or glass-ceramic material. In another embodiment, spacer walls 207, 208 are formed from ceramic tape. Hereafter, in description of embodiments of the invention, ceramic or glass-ceramic tapes and slurries are the materials used for the spacer walls or spacer structures. It is to be understood that other materials, such as ceramic reinforced glass, devitrified glass, metal with electrically insulative coating or high-temperature vacuum-compatible polyimides, could be used.

Ceramic tape is formed from a mixture of ceramic particles, amorphous glass particles, binders and plasticizers. Initially, the mixture is a slurry which can be molded instead of formed into ceramic tape. Ceramic tape can be formed from the slurry and, in an unfired state, is a deformable material which can easily be cut and formed as desired. Ceramic tape may be made in thin sheets, e.g. approximately 3–10 mils. Examples of ceramic tape that can be used with the invention are the tapes provided from Coors Electronic Package Co. of Chattanooga, Tenn. as Product Nos. CC-92771/777 and CC-LT20.

Unfired ceramic tape can readily be formed in the ways to be described below to yield spacer walls and spacer structures according to the invention. After forming, the ceramic tape is fired. The firing occurs in two stages: a first stage in which the tape is heated to a temperature of approximately 350° C. to burn out the binders and plasticizers from the tape, and a second stage in which the tape is heated to a temperature (between 800°–2000° C., depending on the composition of the ceramic) at which the ceramic particles sinter together to form a strong, dense structure.

Spacer walls 207, 208 of FIGS. 2A and 2B are formed and assembled into flat panel display 200 as follows. Strips, having a length and width chosen according to the requirements of the particular display for which the spacer walls 207, 208 are to be used, are cut from a sheet of unfired ceramic tape. An advantage of using an unfired ceramic or glass-ceramic is that the strips can be easily fabricated by slitting or die-cutting. The strips are then fired, as described above. The fired strips (spacer walls 207, 208) are placed at appropriate pre-determined locations with respect to addressing grid 206, faceplate 202 and backplate 203, and attached to addressing grid 206 by, for instance, gluing or glass fritting. During assembly of faceplate 202, backplate 203, addressing grid 206 and spacer walls 207 and 208, spacer walls 207 and 208 are held in place so that they are properly aligned with respect to faceplate 202, backplate 203 and addressing grid 206. Proper alignment of spacer walls 207 and 208 can be achieved using, for example, one of the approaches now to be described.

Figure 5A:
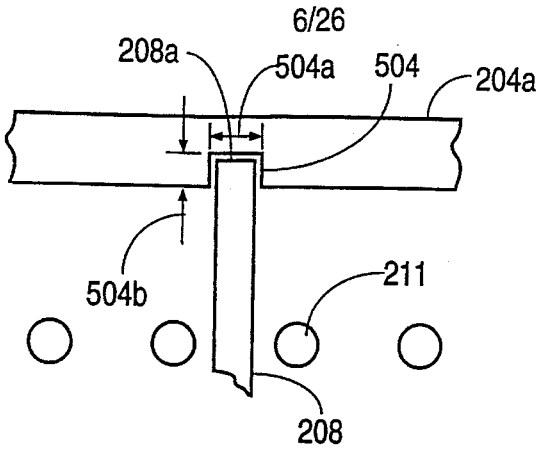
FIGS. 5A, 5B and 5C are detailed views of a portion of FIG. 2B illustrating a means for aligning anode or cathode spacers according to various embodiments of the invention.

FIG. 5A is a detailed view of a portion of FIG. 2B illustrating a means for aligning spacer walls 207 or according to an embodiment of the invention. Notch 504 is cut, in a direction perpendicular to the plane of FIG. 5A, in top wall 204*a* at a location corresponding to the location of anode spacer wall 208.

During assembly of flat panel display 200, end 208*a* of anode spacer wall 208 is inserted into notch 504 and end 208*b* (FIG. 2B) is inserted into a similar notch formed in bottom wall 204*c* so that anode spacer wall 208 is held in place. Width 504*a* of notch 504 is made slightly larger than the thickness of anode spacer wall so that anode spacer wall 208 is held in place in the direction parallel to top wall 204*a* in the plane of FIG. B. In one embodiment, the thickness of anode spacer wall is 4 mils (0.102 mm), and width 504*a* is approximately 4.5 mils (0.0114 mm).

Depth 504*b* of notch 504 is made sufficiently large so that, given dimensioning tolerances, anode spacer wall 208 will fit into, and not slip out of, notch 504. Depth 504*b* of notch 504 is, illustratively, approximately 10 mils (0.25 mm). Anode spacer wall 208 is made sufficiently long so that if end 208*a* begins to move out of notch 504, end 208*b* (FIG. 2B) contacts a corresponding notch formed in bottom wall 204*c* before end 208*a* can move completely out of notch 504. Consequently, anode spacer wall 208 is held in place in the direction perpendicular to top wall 204*a*. If, for instance, depth 504*b* is 10 mils (0.25 mm), anode spacer wall 208 is made slightly less than 10 mils (0.25 mm) longer than the distance 221 (FIG. 2A) between top wall 204*a* and bottom wall 204*c*.

In an alternative embodiment, rather than cutting notches in the top and bottom walls, a notch is cut into addressing grid 206 in which anode spacer wall 208 fits. During assembly of flat panel display 200, anode spacer wall 208 is inserted into the notch cut in addressing grid 206. The width of the notch is made slightly larger than the thickness of anode spacer wall 208. In one embodiment, the width of the notch is approximately 4.5 mils (0.0114 mm). The depth of the notch is, illustratively, approximately 1–2 mils (0.025–0.051 mm).

In another embodiment, notches are cut, as described above, in each of top wall 501*a*, bottom wall 501*b* and addressing grid 206.

Figure 5B:
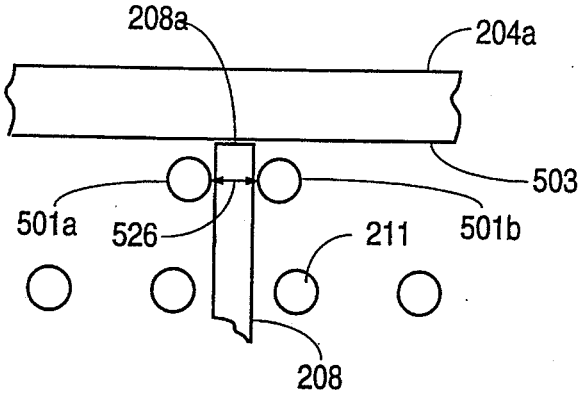

FIG. 5B is a detailed view of a portion of FIG. 2B illustrating a means for aligning spacer walls 207 or 208 according to another embodiment of the invention. Alignment rods 501*a*, 501*b* are located such that, during assembly of flat panel display 200, end 208*a* of anode spacer wall 208 is held in place between alignment rods 501, 501*b*.

Alignment rods 501*a*, 501*b* are passed through corresponding holes formed in addressing grid 206 outside of the active region. Alignment rods 501*a*, 501*b* can be attached to addressing grid 206 by glass fritting or gluing. Alignment rods 501*a*, 501*b* need not extend all the way from faceplate 202 to backplate 203.

Distance 526, the shortest distance, measured in a direction parallel to top wall 204*a* in the plane of FIG. 2B, between alignment rods 501*a* and 501*b*, is made slightly greater than the thickness of anode spacer wall 208. In one embodiment, the thickness of anode spacer wall 208 is 4 mils (0.102 mm) and distance 526 is approximately 4.5 mils (0.114 mm).

Anode spacer wall 208 is made sufficiently long so that if end 208*a* begins to move away from surface 503 of top wall 204*a*, end 208*b* (FIG. 2B) contacts bottom wall 204*c* before end 208*a* can move far enough away from surface 503 so that end 208*a* can move past one of alignment rods 501*a*, 501*b*. Consequently, anode spacer wall 208 is held in place in the direction perpendicular to top wall 204*a*. Typically, the length of anode spacer wall 208 is made just slightly less than the distance 221 (FIG. 2A).

Though only two alignment rods 501*a*, 501*b* adjacent top wall 204*a* are shown in FIG. 5B, three or more alignment rods could be used. If an odd number of alignment rods are used, the alignment rods are staggered so that the alignment rods on one side of anode spacer wall 208 are different distances from top wall 204*a* than the alignment rods on the other side of anode spacer wall 208.

Figure 5C:
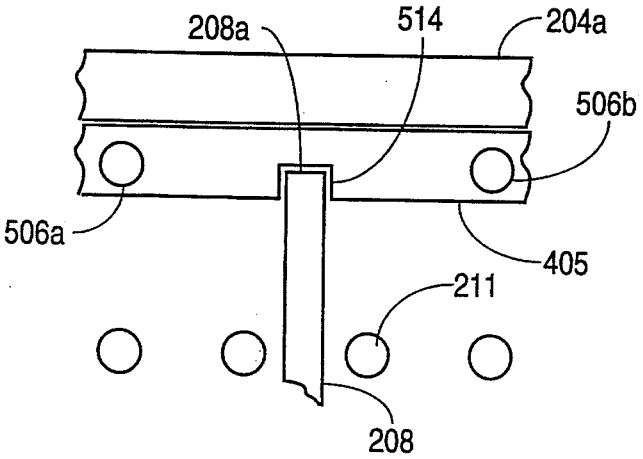

FIG. 5C is a detailed view of a portion of FIG. 2B illustrating a means for aligning spacer walls 207 or 208 according to another embodiment of the invention. Alignment bar 505 is held in place, outside the active area of the display, by pins 506*a*, 506*b*. Pins 506*a*, 506*b* are passed through corresponding holes formed in addressing grid 206. Pins 506*a*, 506*b* can be attached to addressing grid 206 by glass fritting or gluing. Alignment bar 505 can also be held in place by gluing or glass fritting alignment bar directly to addressing grid 206. Alignment bar 505 and pins 506*a*, 506*b* need not extend all the way from faceplate 202 to backplate 203. Alignment bar 505 and pins 506*a*, 506*b* are made of, for instance, glass, ceramic, glass-ceramic or metal.

Notch 514 is cut, in a direction perpendicular to the plane of FIG. 5C, in alignment bar 505*a* at a location corresponding to the location of anode spacer wall 208. During assembly of flat panel display 200, end 208*a* of anode spacer wall 208 is inserted into notch 514 and end 208*b* (FIG. 2B) is inserted into a similar notch formed in a alignment bar near bottom wall 204*c* so that anode spacer wall 208 is held in place. The dimensional relationships between notch 514 and anode spacer wall 208, and illustrative dimensions, are the same as given above with respect to FIG. 5A.

Though the above descriptions with respect to FIGS. 5A, 5B and 5C are made with respect to end 208*a* of anode spacer walls 208, it is to be understood that end 208*b* (FIG. 2B) is held in place during formation of flat panel display 200 using similar means. Further, cathode spacer walls 207 can be held in place during formation of flat panel display 200 using means similar to that described for anode spacer walls 208.

Figure 6A:
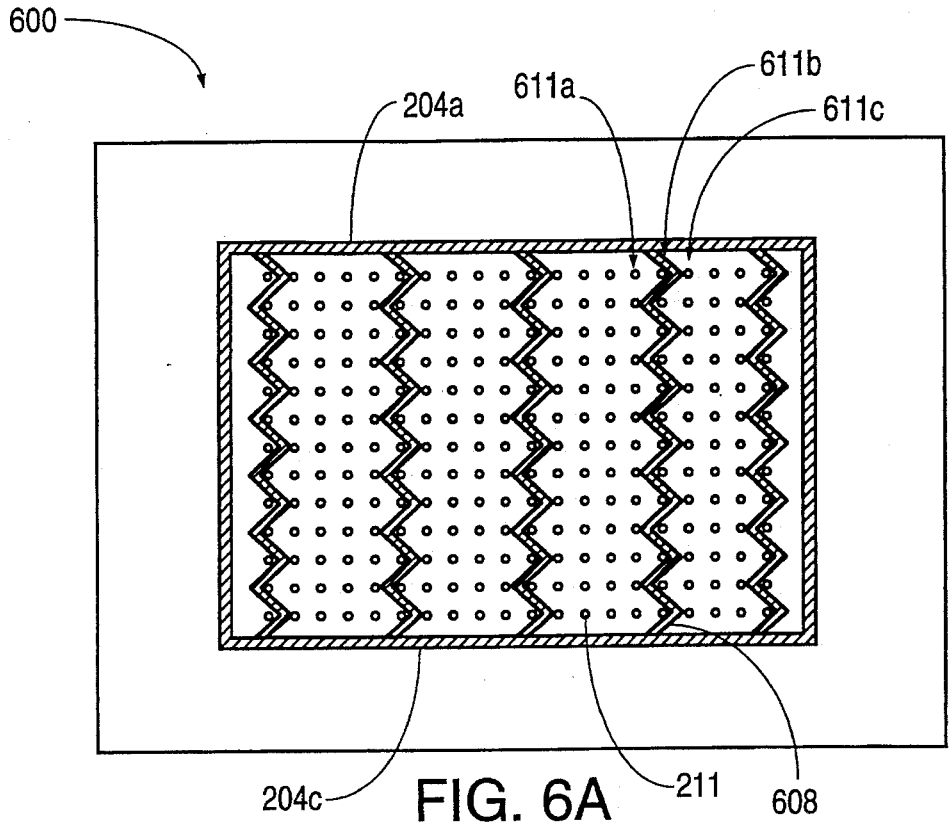
FIGS. 6A and 6B are cross-sectional views of flat panel devices illustrating additional embodiments of spacers according to the invention.
Figure 6B:
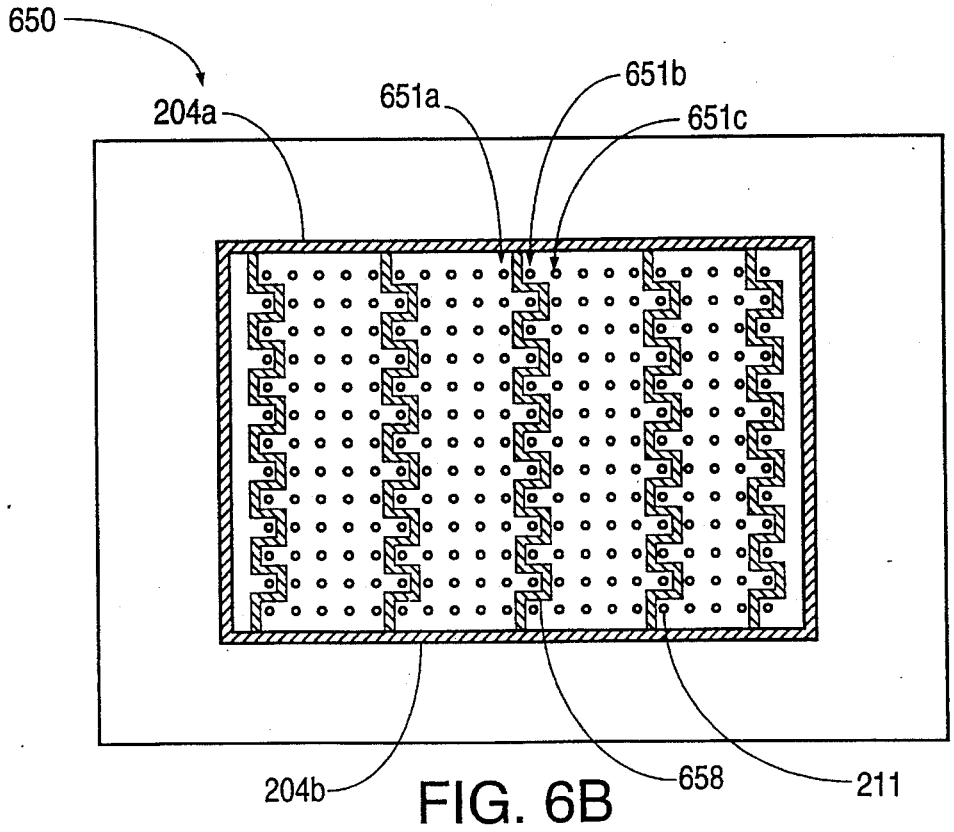

In the above description, spacer walls 207 and 208 follow a straight line path between rows of holes 211 from top wall 204*a* to bottom wall 204*c*. FIGS. 6A and 6B are cross-sectional views of flat panel displays 600 and 650, respectively, according to additional embodiments of the invention, in which spacer walls 608 and 658, respectively, follow other than a straight line path through holes 211 from top wall 204*a* to bottom wall 204*c*. In FIG. 6A, spacer walls 608 zig-zag diagonally between three rows, e.g., rows 611*a*, 611*b*, 611*c* of holes 211. In FIG. 6B, spacer walls 658 zig-zag rectangularly through three rows 651*a*, 651*b*, 651*c* of holes 211. In either of FIGS. 6A or 6B, the zig-zag paths can be formed so that spacer walls 608 or 658 extend for longer distances before changing direction so that the zig-zag path of spacer walls 608 or 658 extends among more than three rows.

Figure 7A:
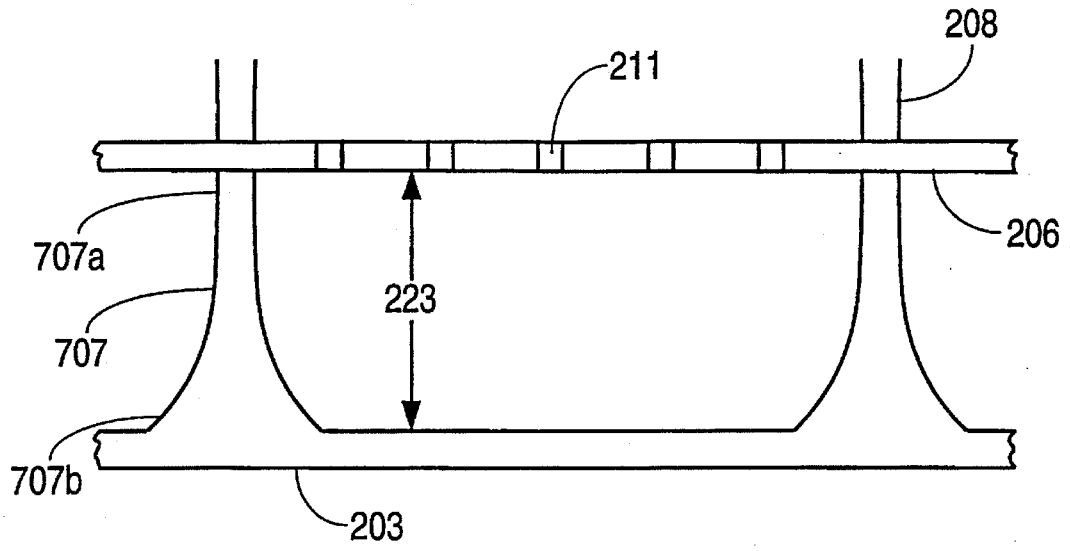
FIGS. 7A and 7B are cross-sectional views, viewed in the same direction as FIG. 2A, illustrating alternative embodiments of cathode spacers according to the invention.
Figure 7B:
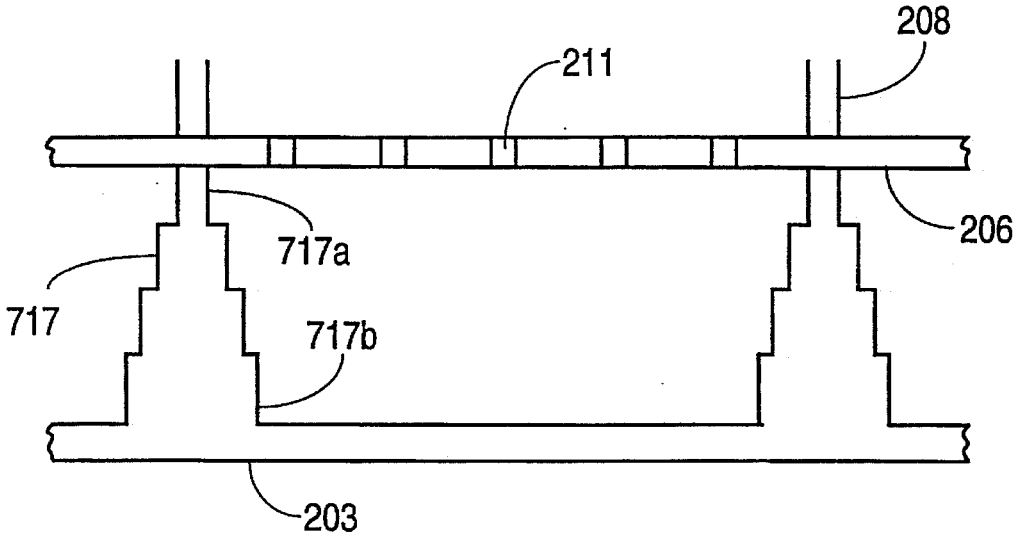

FIGS. 7A and 7B are cross-sectional views, viewed in the same direction as FIG. 2A, illustrating alternative embodiments of cathode spacer walls 707 and 717, respectively, according to the invention for use with flat panel display 200. In both FIGS. 7A and 7B, cathode spacer walls 707 and 717 are made thicker at end 707*b* or 717*b* contacting backplate 203 (FIG. 2A) than at end 707*a* or 717*a* contacting addressing grid 206 (FIGS. 2A and 2B). Consequently the position of directional electrodes 210 (FIG. 2A) is different than for cathode spacer walls 207; this may be desirable to help distribute the flow of electrons from cathode wire 209 (FIG. 2A) so that when the electrons reach addressing grid 206, the distribution of electrons is substantially uniform (i.e., within a range of approximately 3%) in a plane parallel to addressing grid 206. Cathode spacer walls 707 or 717 as in FIGS. 7A and 7B are also desirable when distance 223 (FIG. 2A) between the interior surface of backplate 203 and the facing surface of addressing grid 206 becomes relatively large, i.e., greater than approximately 150 mils (3.81 mm)

The two embodiments of cathode spacer walls 707 and 717 shown in FIGS. 7A and 7B result from two different methods of forming cathode spacer walls 707 and 717. In FIG. 7A, cathode spacer walls 707 are formed by pouring glass-ceramic or ceramic slurry, usually under pressure, into an appropriately shaped mold. Cathode spacer walls 707 can be molded all at once in a single mold such that a layer is formed connecting the ends of cathode spacer walls 707 to form a single integrated structure. In flat panel display 200, this layer contacts backplate 203. Alternatively, the layer can comprise backplate 203. Cathode spacer walls 707 can also be molded separately, then assembled in flat panel display 200 using one of the techniques described above.

In FIG. 7B, cathode spacer walls 717 are formed by laminating together several sheets of unfired ceramic tape. The sheets are cut to different predetermined widths, held together under pressure and heated to a temperature of approximately 70° C. to form cathode spacer walls 717 having a staircase cross-sectional shape as seen in FIG. 7B. After the sheets are laminated, they are fired, as described above, to remove binders and to impart mechanical strength and stiffness.

Figure 7C:
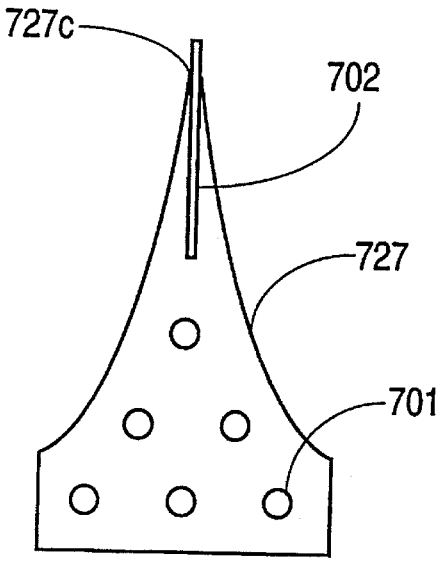
FIGS. 7C and 7D are a cross-sectional and perspective view, respectively, of an embodiment of a cathode spacer that could be the cathode spacer of FIGS. 7A or 7B, respectively.
Figure 7D:
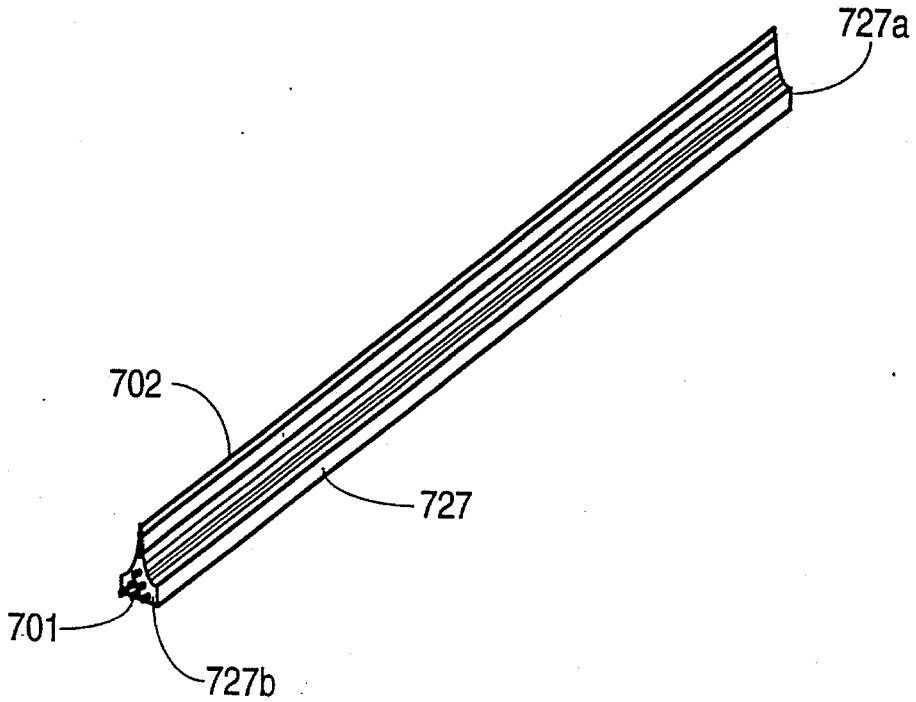

FIGS. 7C and 7D are a cross-sectional and perspective view, respectively, of cathode spacer 727 that could be cathode spacer 707 or 717 of FIGS. 7A or 7B, respectively. Alignment plate 702, which can be a metal or dielectric sheet, can be plate molded into cathode spacer 727 to extend from upper edge 727*c* of cathode spacer 727. Because alignment plate 702 can be made independently from the molded structure to which it is attached, alignment plate 702 can have desirable properties other than those of the molded structure, e.g., alignment plate 702 can be thin to fit between rows of holes 211 without disturbing the electron flow and alignment plate 702 can be made of metal for strength.

As previously noted, phosphor or phosphor patterns are coated on the interior surface of faceplate 202. The region of faceplate 202 in which phosphor is coated is called the active region. (Note: "Active region" has been used elsewhere in this description to denote, in addition to the above-described region of faceplate 202, the projected area of that region of faceplate 202 in any plane parallel to faceplate 202.) The entire active region may not be covered by phosphor. The phosphor can be segmented into regions. Phosphor regions can be defined by surrounding them with a black border to improve contrast; the black border is called a "black matrix." In order to avoid a "prison cell effect" on the external viewing surface of faceplate 202, anode spacer walls 208 must be located over the black matrix of the active region of faceplate 202 so that anode spacer walls 208 are not seen at the external viewing surface.

In one embodiment of the invention, the black matrix is raised above the phosphor coating on the interior surface of faceplate 202 by photolithographic patterning and etching away of the black matrix material in the areas to be coated with phosphor. Anode spacer walls 208 contact a part of the black matrix. Since the black matrix is raised above the remainder of faceplate 202, even if anode spacer walls 208 slide from their original position on the black matrix, anode spacer walls 208 are held above the phosphor coating by another part of the black matrix so that the phosphor coating is not damaged by anode spacer walls 208.

In another embodiment of the invention, the surface of the black matrix is approximately level with the phosphor coating on faceplate 202. Again, anode spacer walls 208 contact the black matrix.

In the above description of embodiments of the invention, the spacer walls extend from close to the top wall of the flat panel display to close to the bottom wall of the flat panel display. Generally, spacer walls can be formed in any manner to provide support so long as they do not adversely affect the electron flow to the faceplate. For instance, spacer walls could be formed that extend from one side wall to the other side wall of the flat panel display, or spacer walls could extend diagonally across the flat panel display. Which of these two configurations is chosen will depend on the characteristics of the cathode.

Figure 8A:
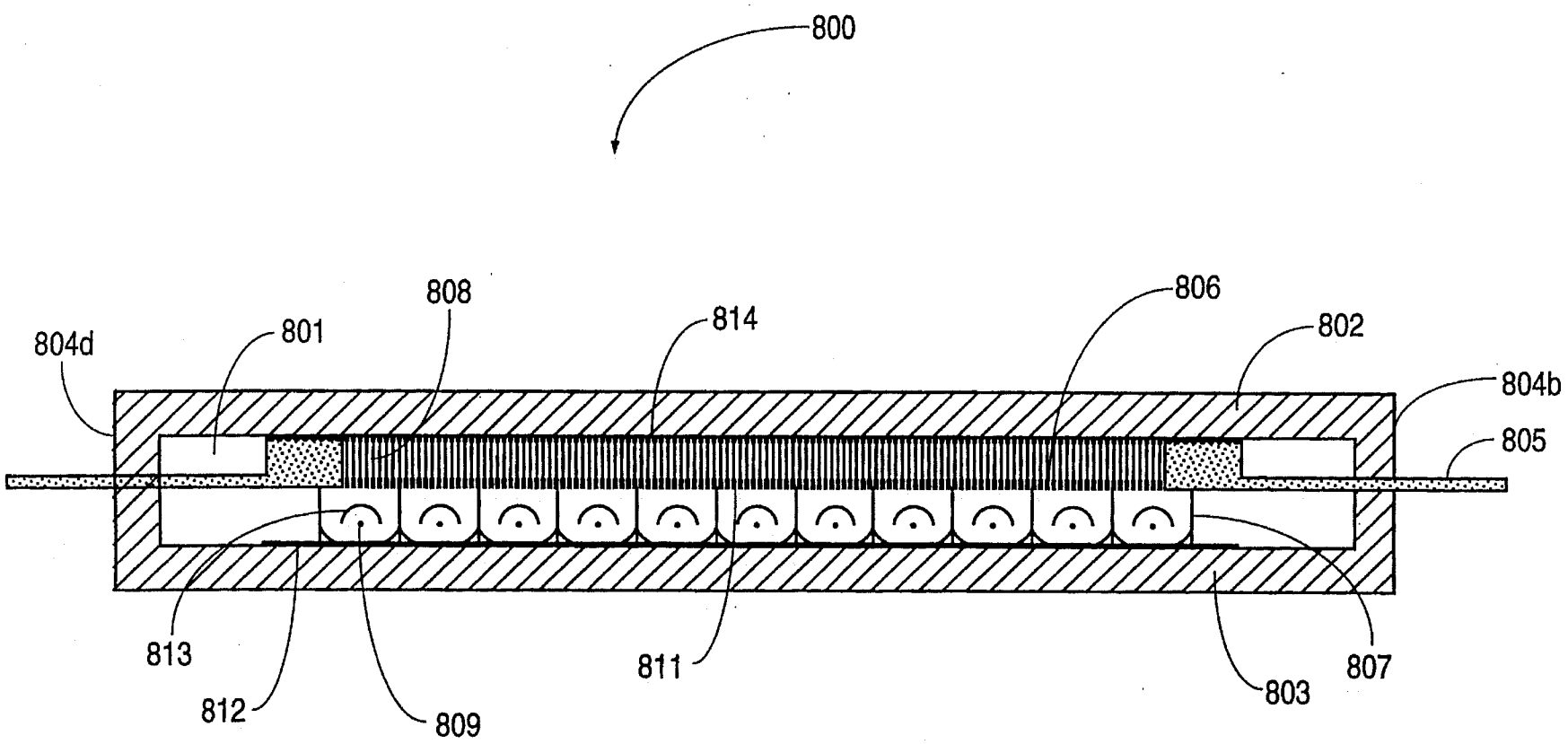
FIG. 8A is a simplified cross-sectional view, viewed in the same direction as FIG. 2A, illustrating a flat panel device according to another embodiment of the invention.

FIG. 8A is a simplified cross-sectional view, viewed in the same direction as FIG. 2A, illustrating flat panel display 800 according to another embodiment of the invention. Faceplate 802, backplate 803, a top wall (not shown), a bottom wall (not shown), and side walls 804*b*, 804*d* form enclosure 801 which is held at vacuum pressure of approximately $1\times10^{-7}$ torr. The interior side of faceplate 802 is coated with phosphor. Layer 805 is disposed between faceplate 802 and backplate 803. Addressing grid 806 is formed on the portion of layer 805 corresponding to the active region of faceplate 802. Cathode spacer walls 807 and anode spacer structure 808 (referred to as a "grid-to-grid spacer structure") are disposed between backplate 803 and addressing grid 806, and faceplate 802 and addressing grid 806, respectively.

A thermionic cathode is located between addressing grid 806 and backplate 803. The thermionic cathode includes cathode wires 809, backing electrodes 812 and electron steering grids 813. Cathode wire 809 is heated to release electrons. A voltage may be applied to backing electrode 812 to help direct the electrons toward addressing grid 806. Electron steering grid 813 may be used to help extract electrons from the filament and distribute the flow of electrons evenly between each cathode spacer wall 807. Voltages applied to electrodes (not shown) formed on the surface of holes 811 formed in addressing grid 806 govern whether the electrons pass through addressing grid 806. Electrons that pass through addressing grid 806 strike the phosphor coated on faceplate 802.

In FIG. 8A, one cathode wire 809 is shown between each cathode spacer wall 807. It is to be understood that there can be more than one cathode wire 809 between each cathode spacer wall 807.

Cathode spacer walls 807 are formed and assembled into flat panel display 800 as described above for cathode spacer walls 207 of FIGS. 2A and 2B. Anode spacer structure 808 is formed as follows. Several layers of unfired ceramic or glass-ceramic material, e.g., ceramic tape, having the same length and width are laminated together as described above with respect to FIG. 7B. Holes are formed through the multilayered laminate structure at locations corresponding to holes 811 in addressing grid 806. The holes can be formed in each layer before lamination, in several layers laminated together, or at one time through all of the layers in the multilayer laminate structure. The multilayer laminate structure (anode spacer structure 808) is then fired, either alone or with addressing grid 806, to remove binders and impart stiffness and strength.

Holes 814 can be formed by a number of methods, including, but not limited to, laser drilling, fluid pressure drilling, etching, molding, or mechanical drilling or punching. Addressing grid 806 can be used as a mask for forming holes 814 in anode spacer structure 808 if holes 814 are formed by drilling or etching.

Holes 814 of anode spacer structure 808 can be formed coaxially with holes 811 of addressing grid 806 or holes 814 can be made larger than holes 811 so that each hole 814 encompasses more than one hole 811. In one embodiment, holes 814 are formed coaxially with holes 811 such that the diameter of holes 814 is larger than the diameter of holes 811. The larger diameter holes 814 allow more room for error in aligning holes 811 and 814.

In alternative embodiments, the diameter of holes 814 remains constant throughout the length of holes 814 to the end of holes 814 adjacent faceplate 802, or the diameter of holes 814 gradually enlarges along the length of holes 814 in a direction toward faceplate 802. In the latter embodiment, holes 814 may overlap each other adjacent faceplate 802; however, some portion of anode spacer structure 808 must remain between holes 814 to contact faceplate 802.

Figure 8B:
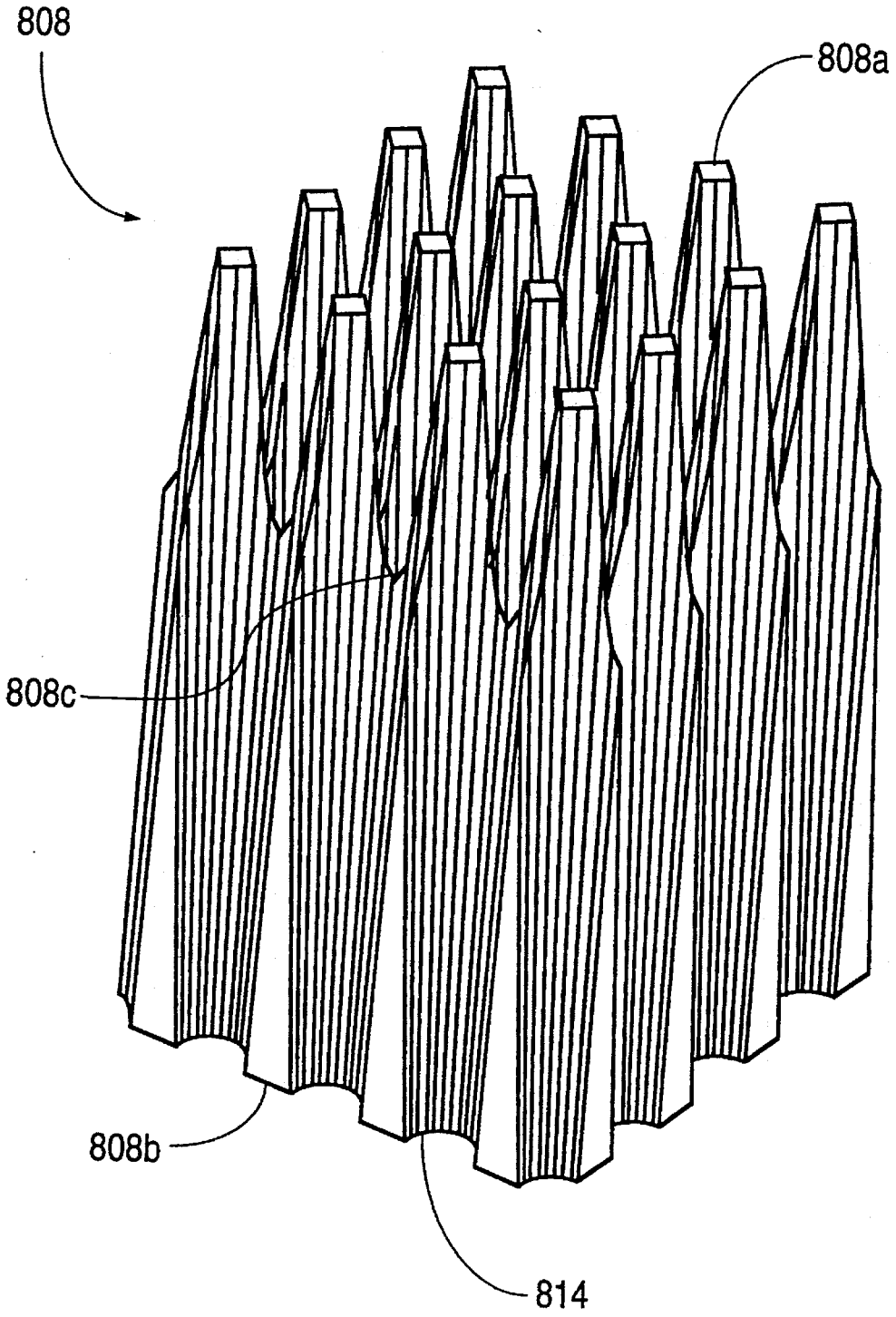
FIG. 8B is a perspective view of a portion of the spacer structure of FIG. 8B according to an embodiment of the invention.

FIG. 8B is a perspective view of a portion of anode spacer structure 808 of FIG. 8A according to an embodiment of the invention in which the diameter of holes 814 gradually increases in a direction toward faceplate 802 and holes 814 overlap each other adjacent faceplate 802. In the embodiment shown in FIG. 8B, holes 814 overlap each other at a location, e.g., location 808*c*, slightly closer to faceplate 802 than backplate 803. In flat panel display 800, end 808*b* of anode spacer structure 808 is adjacent addressing grid 806. As seen, some portions of the surface, e.g., surface 808*a*, of anode spacer structure 808 adjacent faceplate 802 remain between holes 814, despite the overlap of holes 814, so that some surface remains to contact faceplate 802.

Making the diameter of holes 814 increasingly large in a direction from addressing grid 806 to faceplate 802 has several advantages. First, the larger diameter of holes 814 adjacent faceplate 802 decreases the possibility of overlap of anode spacer structure 808 onto the phosphor coated areas of faceplate 802 due to poor registration of anode spacer structure 808 and faceplate 802. Second, it is easier to apply a resistive coating, as described below, to electrically discharge the surfaces of holes 814. Third, the larger diameter of holes 814 will exert less electrical influence on electrons passing through holes 814 so that the flow of electrons is more well-defined. Finally, the formation of holes having an increasing diameter throughout the length of the hole can be done easily by laser drilling because of the natural coning associated with laser drilling. Alternate methods can be used such as a UV-cured mold method described briefly in parent U.S. patent application Ser. No. 07/867,044now U.S. Pat. No. 5,424,605.

A method of making anode structure 808 to provide holes with progressively increasing cross-sectional area from addressing grid 806 to faceplate 802 would be to punch each layer or set of layers with different hole patterns having cross-sectional areas of progressively larger size.

Cathode spacer walls 807 and anode spacer structure 808 can be made of the same material as addressing grid 806. Using the same material, having the same coefficient of thermal expansion, for cathode spacer walls 807, anode spacer structure 808 and addressing grid 806 means that when cathode spacer walls 807, anode spacer structure 808 and addressing grid 806 are heated during assembly or operation of flat panel display 800, cathode spacer walls 807, anode spacer structure 808 and addressing grid 806 will each expand and contract the same amount so that registry of holes 811 and 814 is maintained and cathode spacer walls 807 do not overlap holes 811. Consequently, cathode spacer walls 807, anode spacer structure 808 and addressing grid 806 are more easily formed, since no compensation for different thermal expansion coefficients must be made in order to maintain registry between holes 811 and 814, and alignment between cathode spacer walls 807 and addressing grid 806 when assembling cathode spacer walls 807, anode spacer structure 808 and addressing grid 806.

In an alternative embodiment, anode spacer structure 808 and addressing grid 806 can be formed at the same time by laminating together all of the layers used to form anode spacer structure 808 and addressing grid 806, then firing the combined structure as described above. Additionally, if anode spacer structure 808 and addressing grid 806 are made of the same material, holes 811 and 814 in anode spacer structure 808 and addressing grid 806, respectively, can be formed at the same time by laminating together all of the layers used to form anode spacer structure 808 and addressing grid 806, then forming holes 811 and 814 using one of the methods described above before firing the combined structure.

If desired, metallization can be formed on some or all of the layers of anode spacer structure 808. Such metallization could be, for instance, electrodes that are used for focusing the electrons or fixing the voltage on certain areas of anode spacer structure 808 as the electrons move toward faceplate 802.

Though in the above description, holes having a circular cross-sectional shape are formed through anode spacer structure 808, holes having other cross-sectional shapes could be formed, e.g., "racetrack," oval, rectangular, diamond, etc.

Figure 9A:
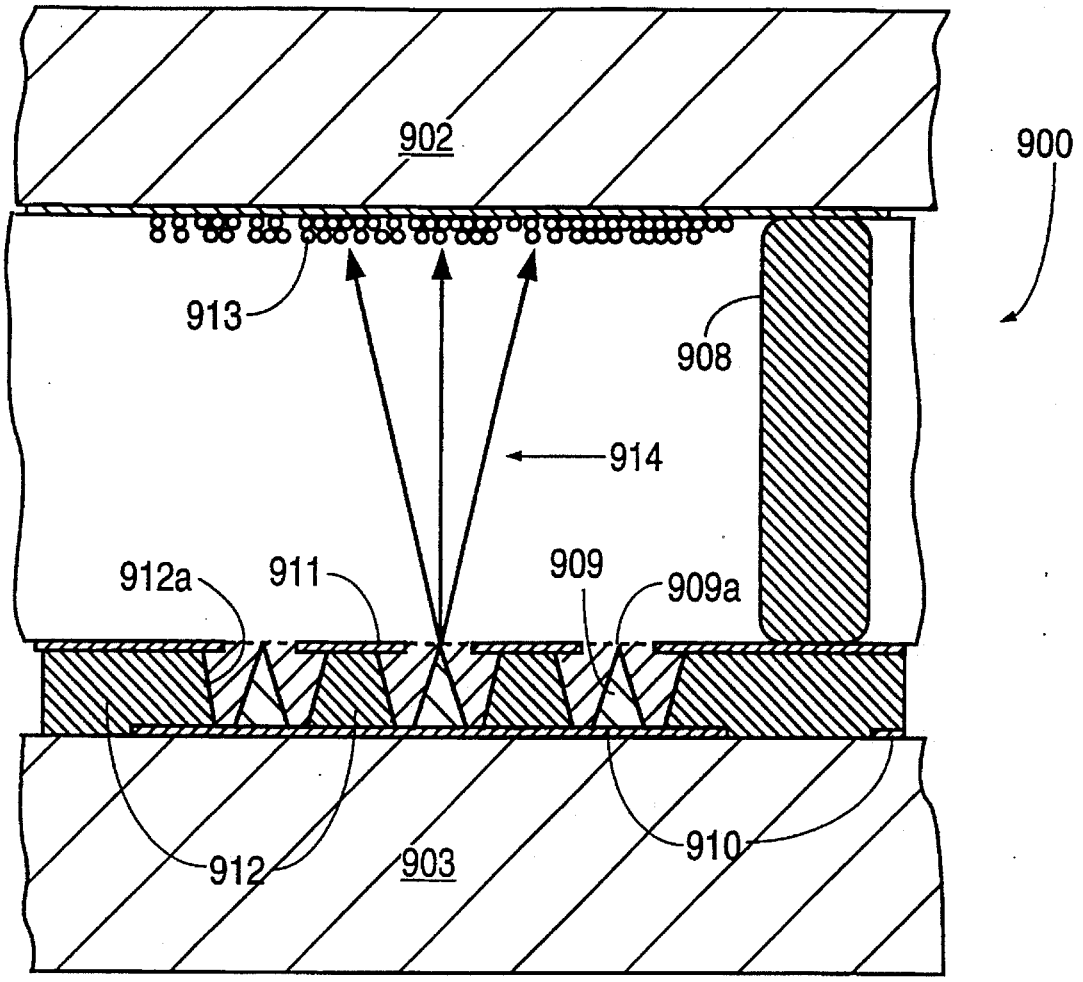
FIG. 9A is a simplified cross-sectional view, viewed in the same direction as FIG. 2A, illustrating an embodiment of a flat panel device according to the invention including a field emitter cathode and spacer walls.

FIG. 9A is a simplified cross-sectional view, similar to the cross-sectional views of FIGS. 2A and 8A, of a portion of flat panel display 900, illustrating the use of anode spacer walls 908 according to the invention in flat panel display 900 using a field emitter cathode (FEC) structure. A particular type of FEC structure is shown in FIG. 9A and in FIGS. 9B and 9C below. It is to be understood that other types of FEC structures could be used.

The FEC structure includes row electrodes 910 formed on electrically insulative backplate 903. Insulator 912 (made of an electrically insulative material) is formed on backplate 903 to cover row electrodes 910. Holes 912*a* are formed through insulator 912 to row electrodes 910. Emitters 909 are formed on row electrodes 910 within holes 912*a*. Emitters 909 are cone-shaped and tip 909*a* of emitter 909 extends just above the level of insulator 912. It is to be understood that other types of emitters could be used. Column electrodes 911 are formed on insulator 912 around holes 912*a* such that column electrodes 911 extend partially over holes 912*a* to a predetermined distance from emitter tips 909*a*. An open space separates column electrodes 911 and emitter tips 909*a* from faceplate 902. Anode spacer walls 908 extend from the column electrodes to faceplate 902.

The open space between the FEC structure and faceplate 902 is held at vacuum pressure of approximately $10^{-7}$ torr. Phosphor 913 is formed on the surface of faceplate 902 facing the FEC structure. Emitters 909 are excited to release electrons 914 which are accelerated across the open space to strike the phosphor 913 on faceplate 902. When phosphor 913 is struck by electrons 914, phosphor 913 emits light.

Anode spacer walls 908 are formed in the same manner as anode spacer walls 208 used with a thermionic cathode, as described above with respect to FIGS. 2A and 2B. Any of the embodiments of anode spacer walls used above with thermionic cathodes can be used with flat panel display 900. Alternatively, an anode spacer structure such as anode spacer structure 808 described above (FIGS. 8A and 8B) can be used with flat panel display 900.

Figure 9B:
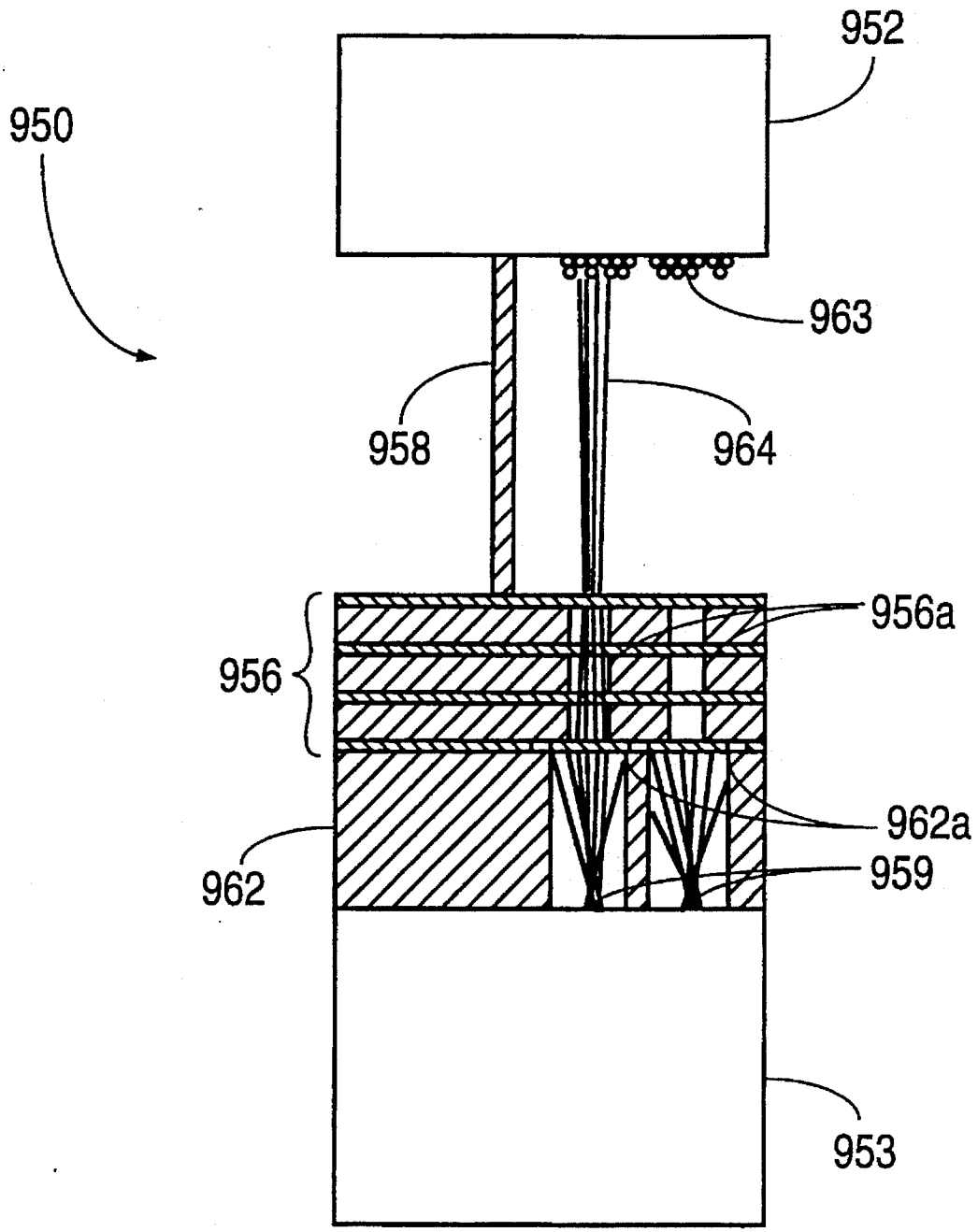
FIG. 9B is a simplified cross-sectional view, viewed in the same direction as FIG. 2A, illustrating another embodiment of a flat panel device according to the invention including field emitter cathodes, spacer walls and an addressing grid.

FIG. 9B is a simplified cross-sectional view, similar to the cross-sectional views of FIGS. 2A and 8A, of a portion of flat panel display 950, illustrating the use of anode spacer walls 958 according to the invention in flat panel display 950 using a FEC structure and addressing grid 956. The use of an addressing grid with a FEC structure is described in detail in U.S. patent application Ser. No. 08/012,297, entitled "Grid Addressed Field Emission Cathode," cited above.

Flat panel display 950 includes faceplate 952 and backplate 953 on which is formed insulating layer 962. Emitters 959 are formed on backplate 953 in holes 962*a* formed in insulating layer 962. Addressing grid 956 is disposed on insulating layer 962. Holes 956*a* are formed through addressing grid 956 such that holes 956*a* are coaxial with holes 962*a*. Emitters 959 release electrons 964 which are accelerated through holes 962*a* and 956*a*, as desired, to hit phosphor regions 963 formed on faceplate 952. Spacer walls 958 support faceplate 952 against addressing grid 956 against the force arising from the differential pressure between the internal vacuum pressure and external atmospheric pressure. Spacer walls 958 are located so that spacer walls 958 do not interfere with the flow of electrons 964.

Figure 9C:
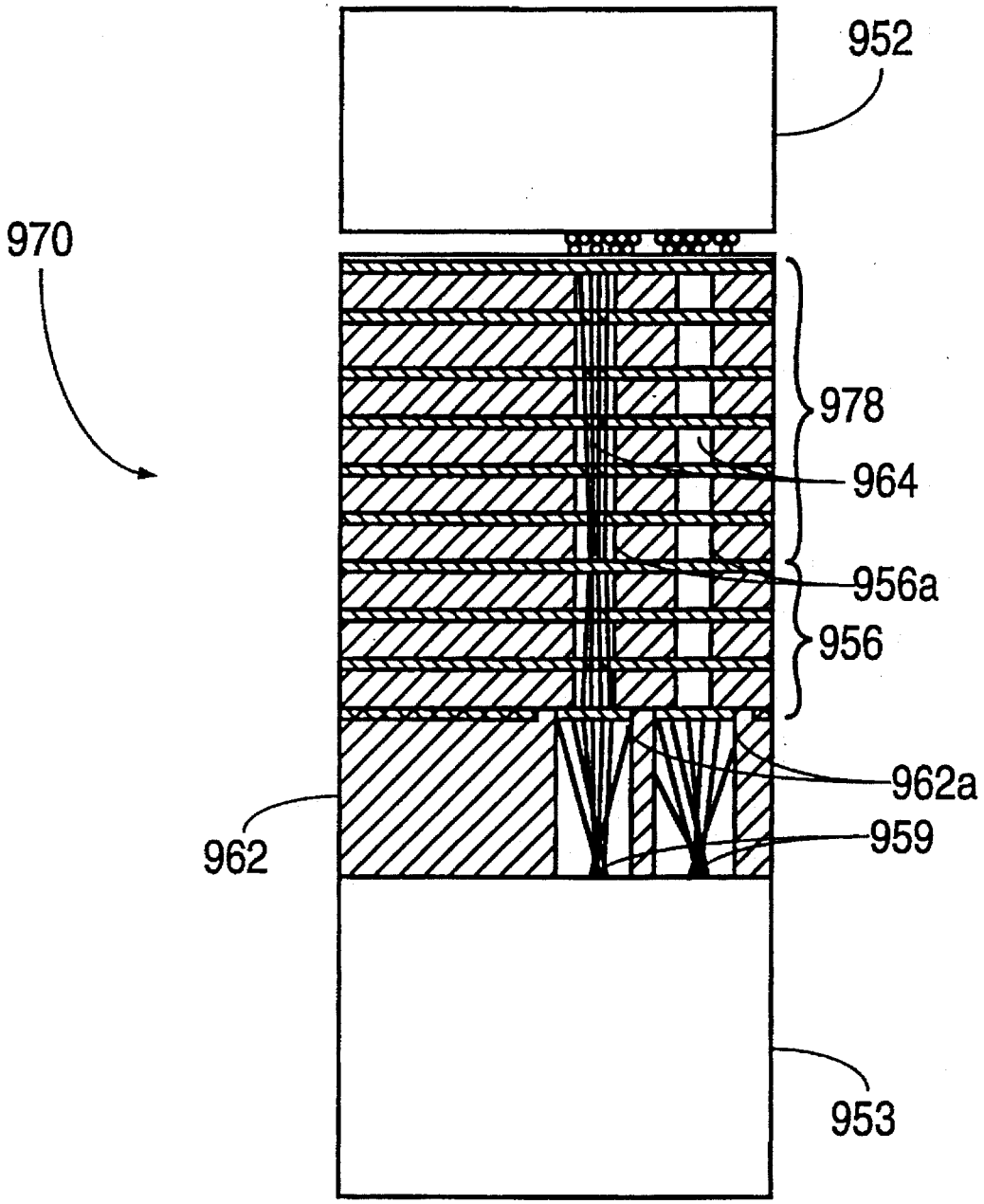
FIG. 9C is a simplified cross-sectional view, viewed in the same direction as FIG. 2A, illustrating another embodiment of a flat panel device according to the invention including a field emitter cathode, a spacer structure and an addressing grid.

FIG. 9C is a simplified cross-sectional view, similar to the cross-sectional view of FIG. 9B, of a portion of flat panel display 970, illustrating the use of anode spacer structure 978 according to the invention in flat panel display 970 including a field emitter cathode (FEC) structure and addressing grid 956. Flat panel display 970 is similar to flat panel display 950 except that spacer structure 978 is used instead of spacer walls 958.

In embodiments of the invention described above including a thermionic cathode, cathode spacer walls, e.g., cathode spacer walls 207, are used to support the backplate, e.g., backplate 203, against the addressing grid, addressing grid 206. As previously noted, a microthermionic cathode in which electrodes are emitted from dots of material formed on the backplate can be used instead of a thermionic cathode in which electrons are emitted from a cathode wire. A microthermionic cathode is structured in a way that is similar to the field emitter cathode structures described above. Consequently, it is possible to use a cathode spacer structure, similar to the anode spacer structure, e.g., anode spacer structure 808, described above, between the backplate, e.g., backplate 203, and the addressing grid, e.g., addressing grid 206, to provide internal support between the backplate and addressing grid of the flat panel display, e.g., flat panel display 200. Such a cathode spacer structure can be used in flat panel displays including either an anode spacer structure or anode spacer walls.

Further, though in the embodiments of the invention described above, only one of a spacer structure or spacer walls have been used on a particular side of the addressing grid, i.e., anode side (between addressing grid and faceplate) or cathode side (between addressing grid and backplate), it is to be understood that some combination of spacer structures and spacer walls could be used on either the anode or cathode side.

Figure 10A:
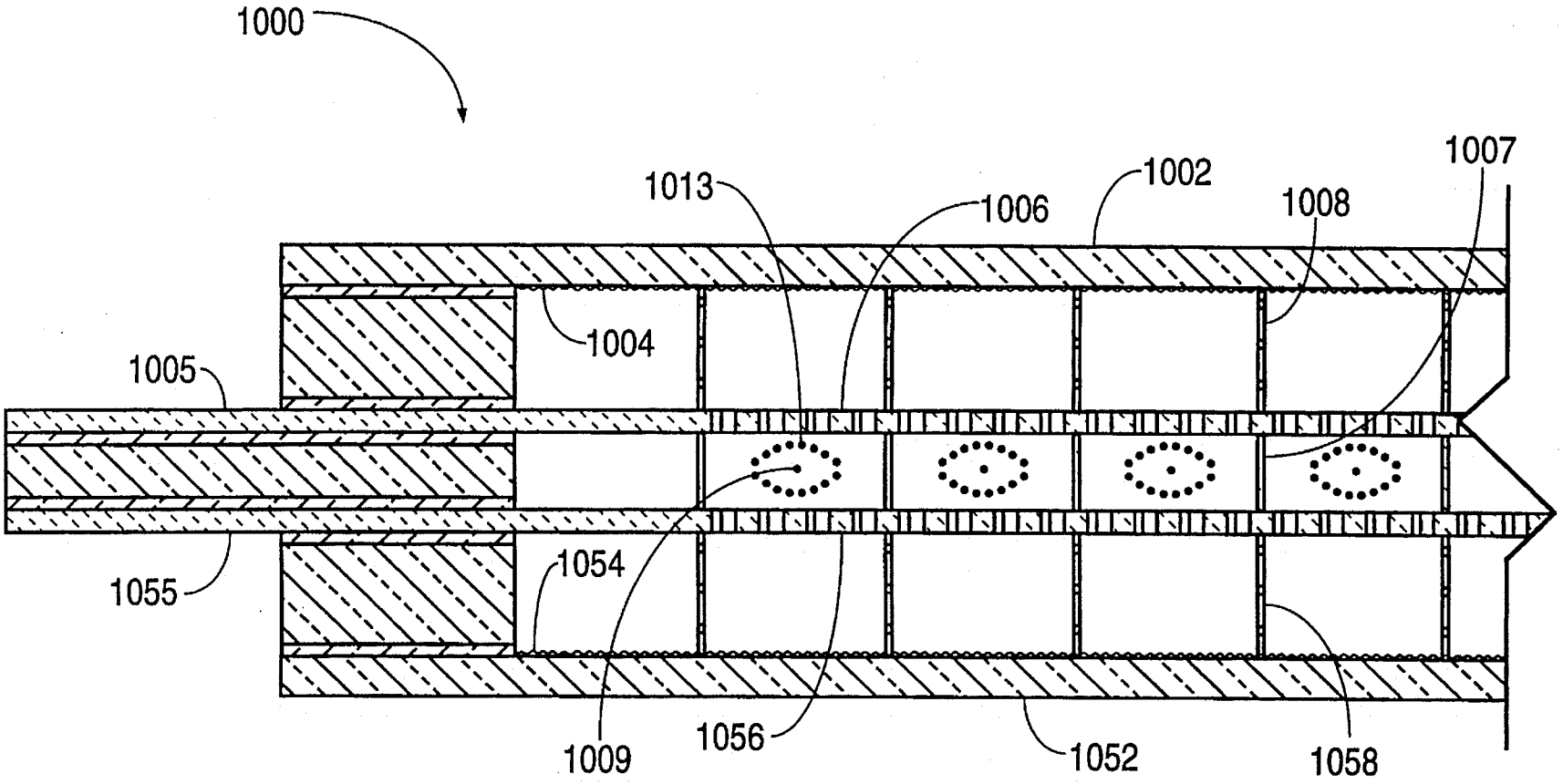
FIG. 10A is a cross-sectional view, viewed in the same direction as FIG. 2A, illustrating the use of spacers according to the invention in a two-sided flat panel device.

FIG. 10A is a cross-sectional view, viewed in the same direction as FIG. 2A, illustrating the use of spacer walls 1007, 1008 and 1058 according to the invention in a two-sided flat panel display 1000. Flat panel display 1000 is similar to flat panel display 200 of FIGS. 2A and 2B, except that, instead of a faceplate 202 and backplate 203 as in flat panel display 200, flat panel display 1000 has two faceplates 1002 and 1052. Phosphor coatings 1004 and 1054 are respectively situated on the inside surfaces of faceplates 1002 and 1052. Two layers 1005 and 1055 are disposed between faceplates 1002 and 1052. Addressing grids 1006 and 1056 are formed on the portions of layers 1005 and 1055, respectively, corresponding to the active region. Spacer walls 1007 (cathode spacer walls), 1008 (anode spacer walls) and 1058 (anode spacer walls) are disposed between addressing grids 1006 and 1056, addressing grid 1006 and faceplate 1002, and addressing grid 1056 and faceplate 1052, respectively. A thermionic cathode is located between addressing grids 1006 and 1056. The thermionic cathode includes cathode wires 1009 and electron steering grids 1013.

Figure 10B:
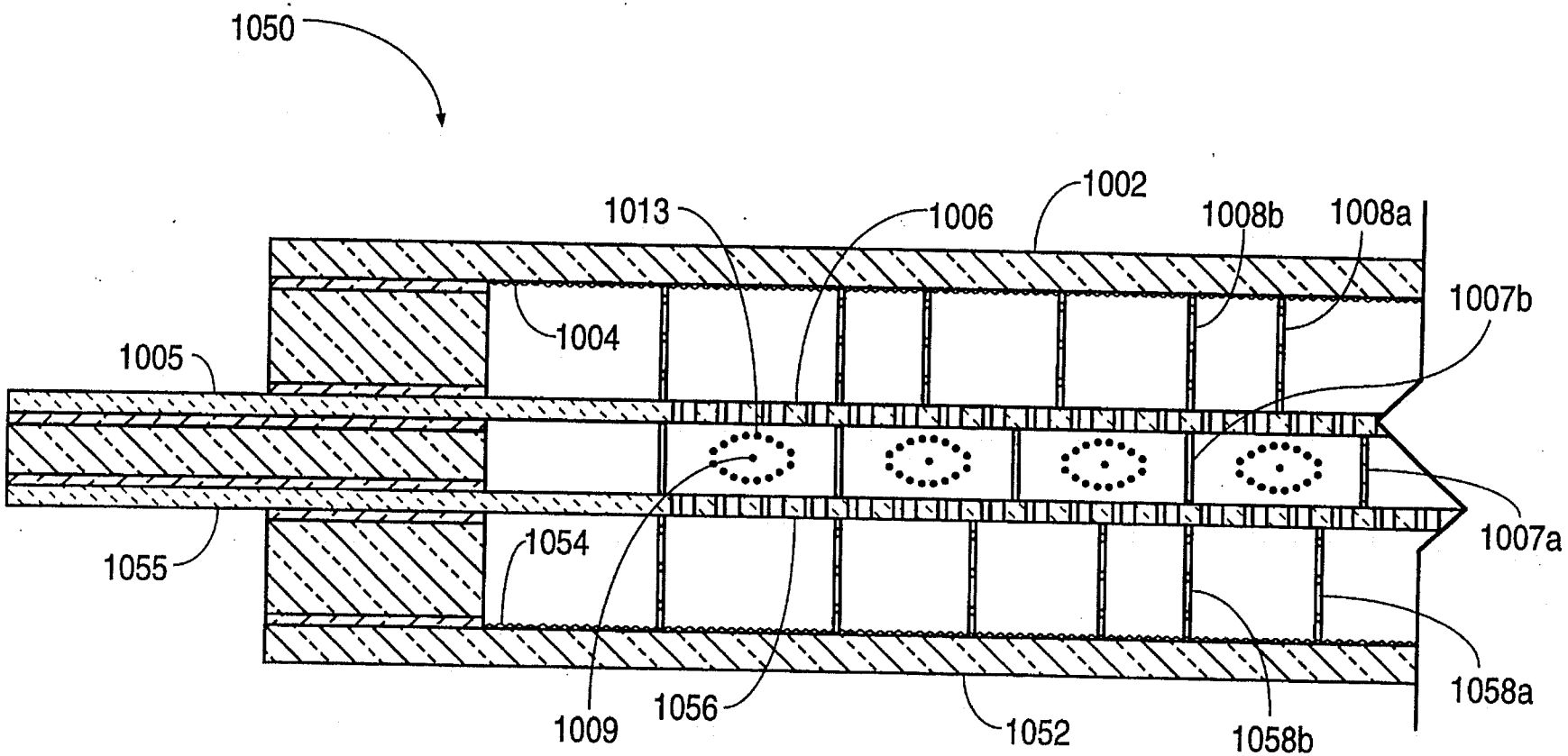
FIG. 10B is a cross-sectional view, similar to FIG. 10A, of a two-sided flat panel device employing matched and unmatched spacers according to the invention.

FIG. 10B is a cross-sectional view, similar to FIG. 10A, of two-sided flat panel display 1050 utilizing matched and unmatched spacer walls. Display 1050 has unmatched cathode spacer walls 1007*a* (not located opposite any anode spacer walls) and matched cathode spacer walls 1007*b* (each located opposite an anode spacer wall 1008*b* and 1058*b*). Display 1050 also has unmatched anode spacer walls 1008*a* and 1058*a* (not located opposite any cathode spacer walls) and matched anode spacer walls 1008*b* and 1058*b* (each located opposite a cathode spacer wall 1007*b*).

Figure 11:
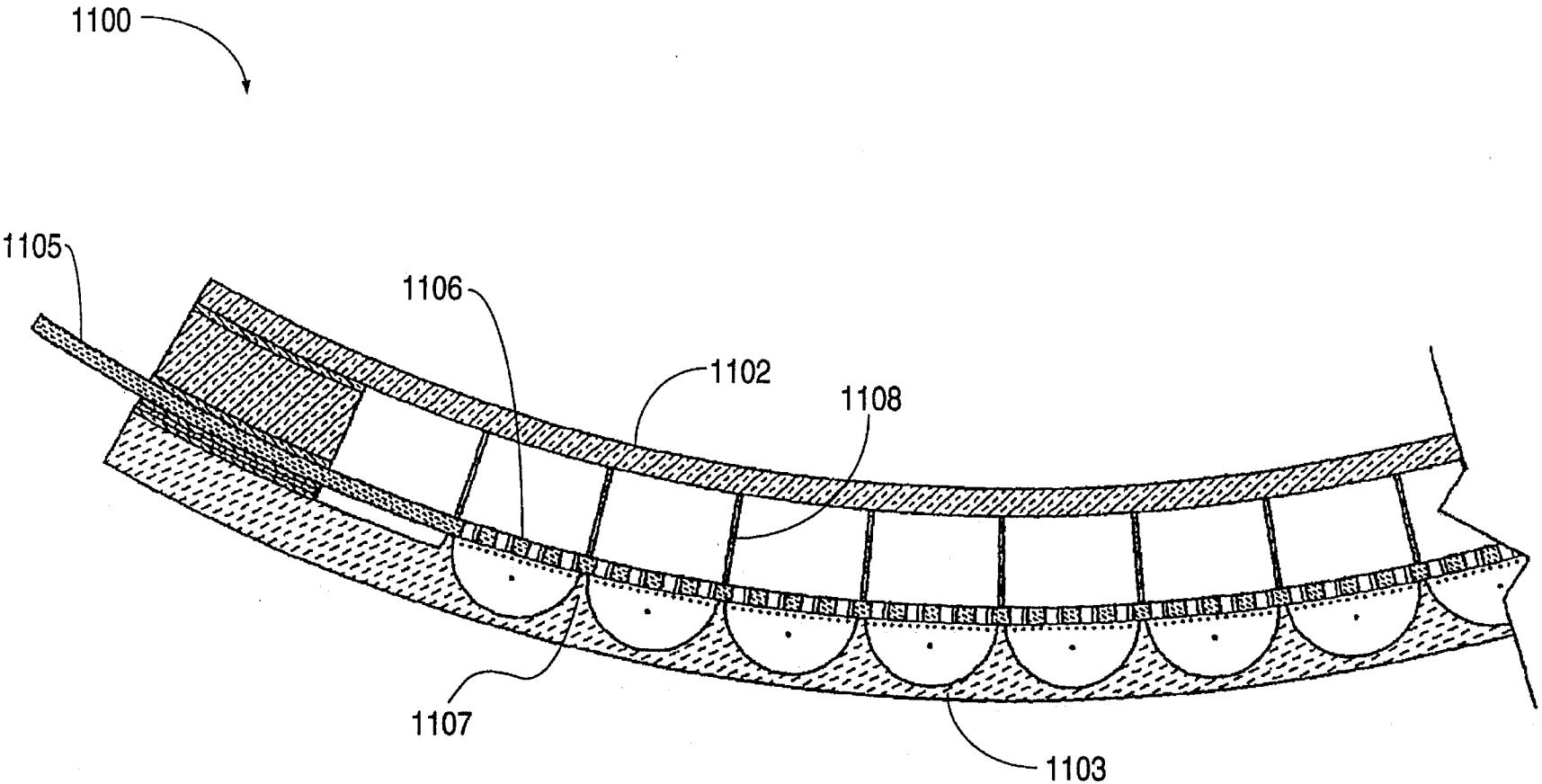
FIG. 11 is a cross-sectional view, viewed in the same direction as FIG. 2A, illustrating the use of spacers according to the invention in a curved flat panel device.

FIG. 11 is a cross-sectional view, viewed in the same direction as FIG. 2A, illustrating the use of spacer walls 1107 and 1108 according to the invention in a curved flat panel display 1100. Flat panel display 1100 is similar to flat panel display 200, except that faceplate 1102, backplate 1103 and layer 1105 are each curved so that flat panel display 1100 is concave as seen by a viewer. Flat panel display 1100 could also be made convex as seen by a viewer.

In each of the above-described embodiments, the spacers must not interfere with the trajectory of the electrons passing between the cathode and addressing grid, and between the addressing grid and the phosphor coating on the faceplate. Thus, the spacers must be sufficiently electrically conductive so that the spacers do not charge up and attract or repel the electrons to a degree that unacceptably distorts the paths of the electrons. Additionally, the spacers must be sufficiently electrically insulative so that there is no large current flow from the high voltage phosphor to the grid.

In one embodiment of the invention, the spacers are made of a partially electrically conductive ceramic or glass-ceramic material. In another embodiment of the invention, the spacers are coated with a resistive material so that charge will flow from the spacers to or from the addressing grid or backplate. The resistivity of the material must be low enough to ensure adequate current flow and high enough to prevent high current flow from the high voltage phosphor to the grid and, thus, large power loss.

In one embodiment of the invention, any bare ceramic on the anode spacer walls, e.g., anode spacer walls 208, is covered with a resistive material having a resistivity of $10^{12}$ ohms/D, and any bare ceramic on the cathode spacer walls, e.g, cathode spacer walls, 207, is covered with a resistive material having a resistivity of $10^6$ ohms/□.

As previously mentioned, ceramic or glass-ceramic materials are desirable for use in making spacers according to the invention. Another example of a low temperature glass-ceramic material which can very advantageously be used for the purposes of this invention is du Pont's Green Tape (trademark of du Pont). This material, available in very thin sheets (e.g. about 3 mils to 10 mils) has a relatively low firing temperature, about 900° to 1000° C., and includes plasticizers in the unfired state which provide excellent workability, particularly in the forming of tiny, closely spaced holes for the addressing grid of the invention. The Green Tape product is a mixture of ceramic particles and amorphous glass, also in particulate form, with binders and plasticizers. See du Pont U.S. Pat. Nos. 4,820,661, 4,867,935, and 4,948,759. The material in the unfired form is adaptable to deposition of conductive metal traces in a glass matrix, such as by screen printing or other techniques. Other materials having the desired pliability in the unfired state, such as devitrifying glass tape, ceramic tape, ceramic glass tape material, and amorphous glass in a flexible matrix, are also adaptable for the purposes of the invention; the term "glass-ceramic" or "ceramic" is used generally herein to refer to this class of materials. Broadly speaking, the requirements of such a material are that (a) it be producible in thin layers, (b) the layers be flexible in the unfired state, (c) holes can be put in a layer or several layers together in the unfired state, (d) the holes can be filled with conductors where desired, (e) conductive traces can be put accurately on the surfaces of the unfired layers, (f) the layers can be laminated, in that they are bonded together at least on a final firing, (g) the fired structure have a coefficient of thermal expansion that can be substantially matched to that of a face plate and a back plate which are made of materials such as float glass, (h) the fired, laminated structure be rigid and strong, (i) the fired structure be vacuum compatible, (j) the fired structure not contain materials which will poison the cathode of the CRT, and (k) all materials and fabrication be possible at practical cost. While the class of glass-ceramic materials mentioned above can be used, other materials having these characteristics or most of these characteristics are becoming available and could also be used. Polyimides, as an example, are very high temperature, high strength vacuum compatible plastics used for the fabrication of multilayer printed circuit boards in such applications as electronics used in space.

As used in the method and construction of the invention, the unfired tape layers with formed holes and deposited metal traces are laminated together at appropriate low temperatures (typically 70° C. in the case of the du Pont Green Tape product) and pressures. This step fuses the layers into a single unit. The laminated layers are subsequently fired to burn out the binders and plasticizers from the tape (approximately 350° C. in the case of the du Pont product).

The final firing (900°–1000° C. in the case of the du Pont Green Tape product) is high enough to sinter the glass particles so that they flow together sufficiently to integrally bond the glass-ceramic layers together. A multi-temperature firing can be used, following a prescribed profile, taking the temperature from room temperature through the burnout temperature to the final temperature and back to room temperature. In this way a fused together, integral addressing grid structure is formed, with conductive traces between the integrally bonded layers and extending to the edges of the structure for connection to driving electronics. Fusing occurs by glass bonding between the layers, in the case of the du Pont product. The integral, self-contained addressing grid structure is achieved with only relatively low firing temperatures, and the materials and method of construction afford efficiency and economy in manufacture.

As an alternative to fusing the layers by firing as described, interlayer bonding can be achieved by diffusion bonding or crystal growth across the boundary (or a combination of these processes). In these processes, pressure is often used to assure intimate contact to facilitate the bonding process. These types of bonding can be used with materials other than glass-ceramics or the family of ceramic tapes as defined herein. For example, in certain applications a pure ceramic (containing no glassy phase) might be utilized. In such applications the fusing together of the layers is carried out by solid state diffusion or crystal growth across the interface.

It has been found that a relatively dense grid of holes can be achieved in the unfired tape material, the integrity and spacing of which are maintained through the firing or with controlled, uniform shrinkage. For holes of 7.5 mil diameter, a density of 3460 holes per square inch has been achieved, through layers of about 10 mil thickness. Holes of 4 mil diameter have been achieved at 1600 holes per square inch through layers of about 3.5 mil thickness. This tape thickness and hole diameter would be appropriate, for example, in a 10 inch diagonal VGA display.

In an embodiment of the invention in which a ceramic tape produced by Coors Electronic Package Co. is used, holes of 6 mil diameter having a density of 6400 holes per square inch have been achieved through 4 layers of tape having an overall thickness of 24 mils before final firing.

In another aspect of the invention, the flexible unfired glass-ceramic material from which the addressing grid laminate is formed contains a metal oxide substance which is utilized to form a built-in surface resistance sufficient to avoid cumulation of charge on surfaces. It has been known in electron tubes to place a conductive coating such as a thin layer of titanium (formed into $TiO_x$, x typically less than 2) on insulators to keep them from charging up in operation. Various types of conductive coatings have been used for this purpose, typically applied by sputtering onto exposed surfaces. Sputtering is a line-of-sight process, so that the multiplicity of holes in the addressing grid as in this invention would be difficult to coat. A swash plate or similar arrangement might have to be used in order to assure that the conductive coating is applied on the surfaces of the holes themselves. Another approach is to use ion plating which plates onto most surfaces, even non-line of sight.

In another embodiment of the invention, resistive coatings are applied using thermal or plasma assisted chemical vapor deposition. In still another embodiment, such a coating is formed by first applying a metal organic liquid, then processing the metal organic liquid by firing in a reducing or oxidizing atmosphere.

An alternative to introducing any coating to the grid laminate structure is to take advantage of a material contained in the initial glass-ceramic layers which can be made to become slightly conductive in a later firing. In one form of this method, lead oxide is included in the glassy phase of the tape (du Pont's Green Tape, for example, has this component, but it can be added if not present). Upon firing in a reducing environment, some of the lead oxide reduces to lead suboxides and metallic lead. The result is a slightly conductive coating, limited to the surfaces, including the surfaces inside the holes, because of the controlled reducing environment and the isolation of the lead oxide based material below the surface. The process is diffusive, with $H_2$ reducing the $PbO_3$ to both sub-oxides $PbO_x$ and elemental lead, where x is 3 or less. The $H_2$ must diffuse into the ceramic to do so; thus the reduction occurs on exposed surfaces first. Processing time and temperature are used to control the resulting resistance.

The face plate, whether of a single sheet of glass or of the glass-filled construction described above, is advantageously supported against the addressing grid structure, which in turn is supported against the back plate by similar ridges or other supports, by a series of ridges formed on the outer surface of the addressing structure, in a honeycomb type arrangement. The ridges, which may follow zig-zagging or serpentine paths for added strength and appropriate spacing from the holes, may be deposited on the green tape surface and fired along with the addressing laminate, or they may be deposited after firing by an appropriate thickness-controlled process. Discrete points or columns may be deposited as supports on the addressing grid surface, rather than ridges. Injection molding techniques can be used to produce the supports or stand offs. In this approach the glass-ceramic material can be formulated to allow injection molding of the ridges directly onto the laminated grid structure.

Another approach is to use the equivalent of expanded metal honeycomb over the surface. Strips of unfired glass-ceramic material are joined periodically to form a diamond pattern when the set of strips are expanded or separated. Methods such as ultrasonic welding can be used to periodically join the layers of the unfired glass-ceramic. Gas flow through the grid holes can move the honeycomb out of the way of all grid holes, ensuring that no holes are obscured. The standoffs can be fired simultaneously with firing the grid.

Small-screen embodiments can be produced without standoffs between the grid and the face plate, simply relying on the strength of the glass plate, or far fewer standoffs/spacers can be used.

A further advantage of the glass-ceramic material is the ability to match its coefficient of thermal expansion to that of the face plate (which is typically made of a glass sheet) and to the back plate. The coefficient can be selected (by formulation of the glass-ceramic) such that a slight compression is put on the grid structure upon cooling after firing.

Figure 12:
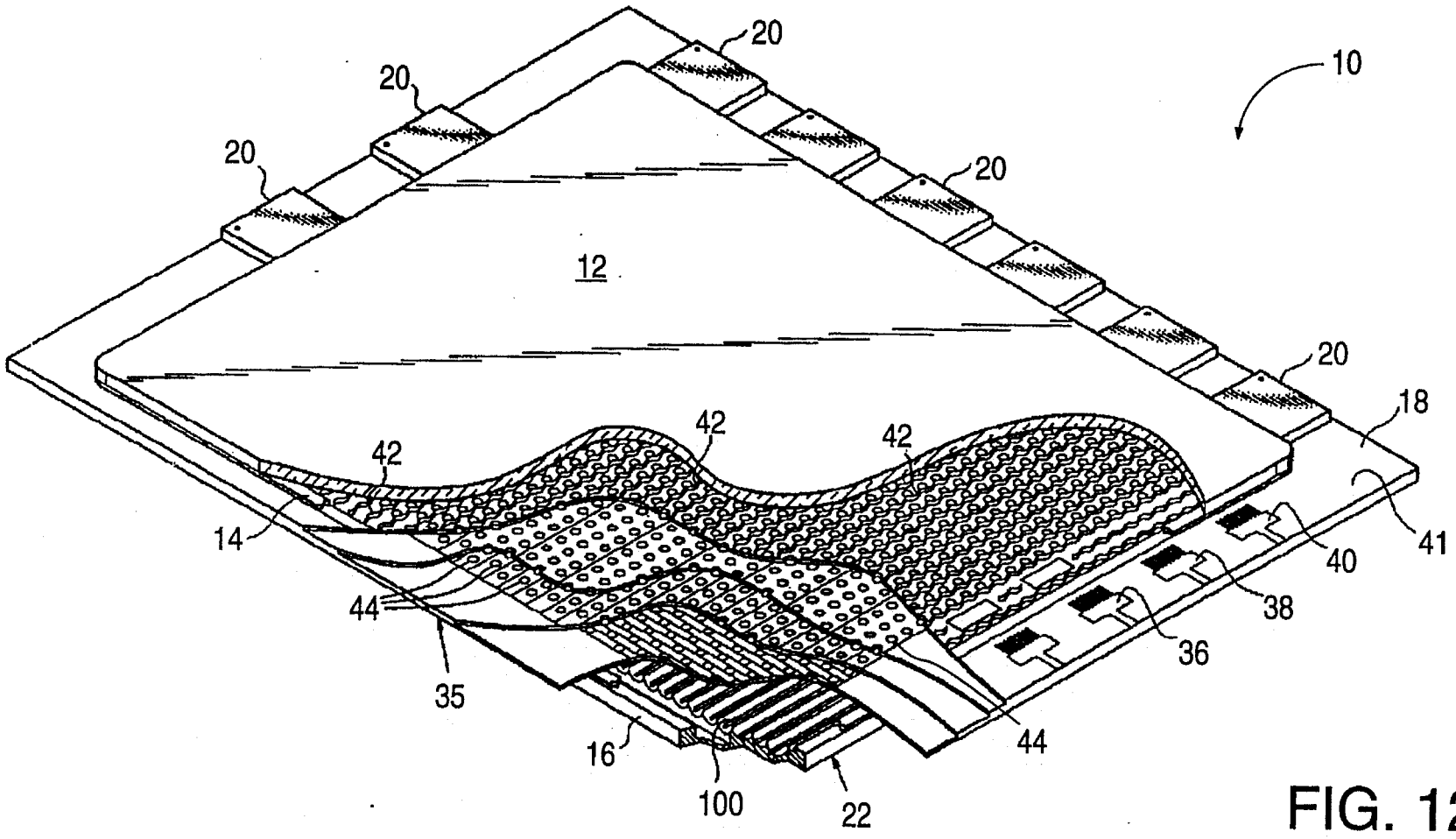
FIG. 12 is a simplified perspective view showing a flat screen CRT assembly in accordance with an embodiment of the invention.

FIG. 12 (which repeats FIG. 1) shows a flat screen, low profile CRT display 10 which has a face plate 12 over a viewing area, a seal area 14 peripheral to the viewing area, a back plate 16 and a peripheral region 18, outside the seal, having electronics 20 including driving circuitry for addressing the movement of electrons against the back, phosphor-coated surface of the face plate 12, which is the anode of the system.

Figure 13:
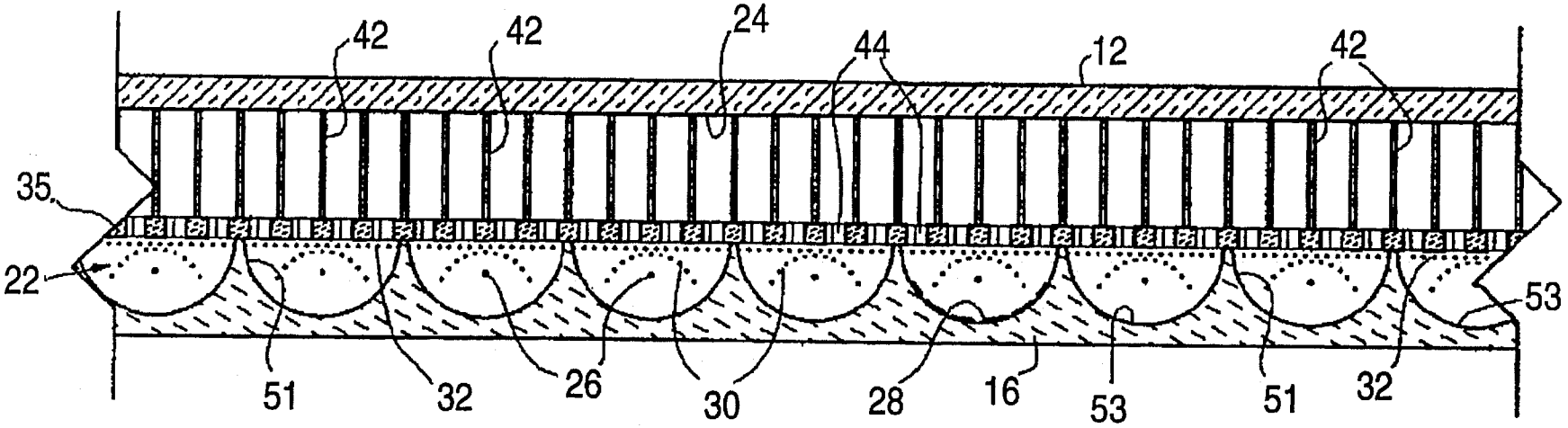
FIG. 13 is a sectional view showing a portion of the flat screen CRT assembly of FIG. 12.

FIG. 13 shows the CRT display 10 in cross section, schematically indicating certain components. The flat screen display device 10 includes a cathode generally identified as 22 for supplying electrons for use in addressing the back anode surface 24 of the face plate 12. Although any of several different types of cathodes may be used, the illustrated cathode comprises a thermionic cathode in which source filaments 26 are heated to give off electrons. A backing electrode 28 may be included, for encouraging the electrons to travel in the direction of the face plate and for reversing the direction of most electrons which do not. The cathode arrangement may also include an electron steering grid 30 (shown in dashed lines), and an accelerating grid 32.

An addressing grid structure 35 is adjacent to the face plate, and this addressing grid, formed of, for instance, a low temperature cofired glass-ceramic material or "green" tape, has an advantageous construction forming an important part of the invention. In this description and in the claims which follow, the term "ceramic" is often used, in the context of ceramic tape or a ceramic layer or ceramic sheet. The term is intended to refer to any of a known family of glass-ceramic tapes, devitrifying glass tapes, ceramic glass tapes, ceramic tapes or other tapes which have plastic binders and ceramic or glass particles and which are flexible and workable in the unfired state, curable to a hard and rigid layer on firing, as well as other materials equivalent thereto, which are initially flexible and may be processed to a final hard and rigid state.

Also indicated in FIG. 12 are spacers 42 (also called supports) on the surface of the addressing grid 35, which may be relatively thin and which provide a network of support for the glass face plate 12, against the effect of near-perfect vacuum existing inside the tube under the glass. The supports 42, as will be further discussed below, may be formed in several different ways and must be positioned around a multiplicity of small holes 44 in the addressing grid, the holes forming pathways for the movement of electrons from the cathode 22 to the back surface 24 of the face plate (see FIG. 13).

It is emphasized that the drawings are illustrative only, are not to scale and do not show the actual number or density of holes 44, as well as not being to scale in every case.

The sectional view of FIG. 13 also illustrates the positioning of the face plate supports 42, between addressing holes 44. These supports 42, which need not be present between every pair of adjacent holes 44 or every row of holes, provide a sufficiently closely spaced web or network of support for the face plate 12 that the face plate can actually be quite thin and is well able to withstand the pressure caused by near-perfect vacuum existing inside the tube. In this way the face plate is able to be perfectly flat if desired, in contrast to traditional CRTs wherein a relatively heavy face plate was bowed or arched outwardly to help withstand the vacuum. The supports 42 may comprise sinuous ridges as indicated in FIG. 12. The sinuous aspect adds greatly to the strength of the preferably very thin supports and support ridges, and also can insure that the supports do not unduly interfere with the flow of electrons from the addressing holes 44.

These supports 42 may be formed by several different processes, as further discussed below in reference to FIG. 15. One process is to use glass-ceramic layers such as those used in the addressing grid itself, with the unfired glass/ceramic material stamped out to leave a desired pattern of ridges as a web which will be non-coincident with any of the active addressing holes 44 in the finished assembly.

FIG. 13 also shows rear supports 51 for engaging the back of the addressing grid 35 between holes. These supports or support ridges 51 are between troughs or recesses 53, each of which provides space for a longitudinally-running cathode wire 26. Semi-circular/cylindrical crenulations are shown in FIG. 13, although other shapes can be used. Techniques for forming these support ridges 51 and troughs 53 are described further below.

Figure 14A:
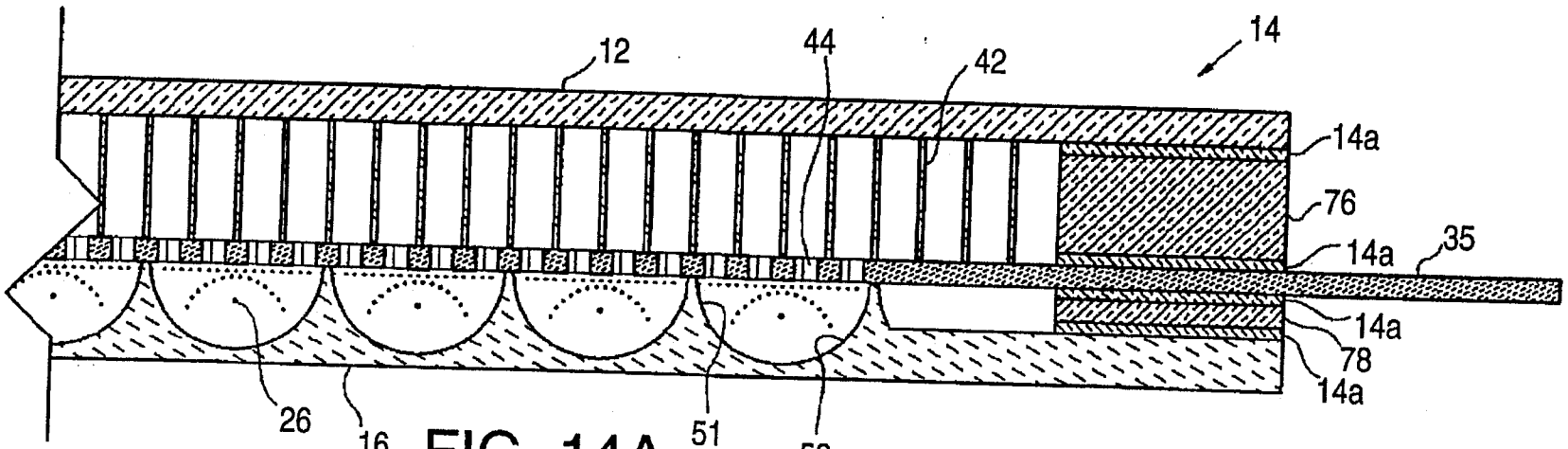
FIG. 14A is a schematic sectional view showing a seal area of the assembly shown in FIGS. 12 and 13.

FIG. 14A is a sectional view of one edge of the assembly, showing the multilayer addressing grid structure 35 extending through the seal area 14. Spacers 76 and 78 are shown above and below the multilayer structure 35, with the face plate 12 above the grid structure and the back plate 16 below. A few of the supports 42 (illustrated in FIG. 12) are also indicated, inboard from the spacer 76, and the spacers together hold the face plate 12 in position against the pressure created by vacuum existing in the tube. Back plate supports 51 are also visible in FIG. 14A, supporting the multilayer grid 35 as spaced from the back plate 16.

Figure 14B:
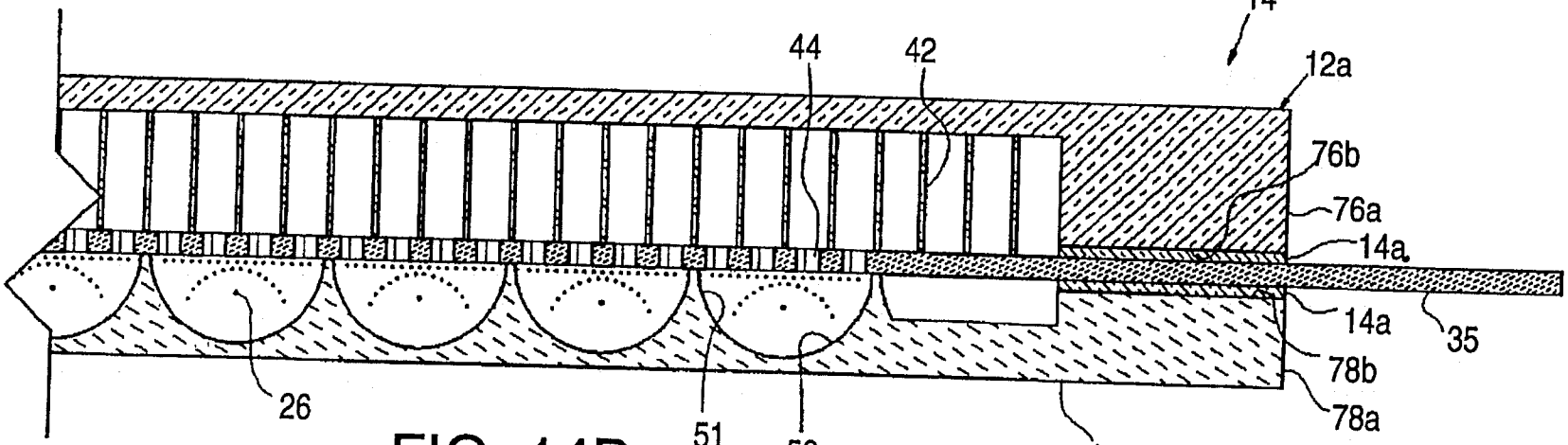
FIG. 14B is a view similar to FIG. 14A, but showing an alternative feature relative to spacers of the assembly.

FIG. 14B shows an alternative structure wherein the back spacers 78 and the front spacer 76 at the seal are avoided. The back plate 16*a* is formed by a molding or casting technique, with an integral spacer comprising a boss 78*a* with a flat ridge 78*b* at the seal, at essentially the same height as the tips of the support ridges 51. A process for providing the back plate with supports 51 and troughs 53 is discussed in greater detail below.

FIG. 14B also shows a modified face plate 12*a* with an integral spacer 76*a* having a flat surface 76*b* for sealing against the grid structure 35.

Figures 15A, 15B, 15C, 15D, 15E, 15F, 15G, 15H, 15I:
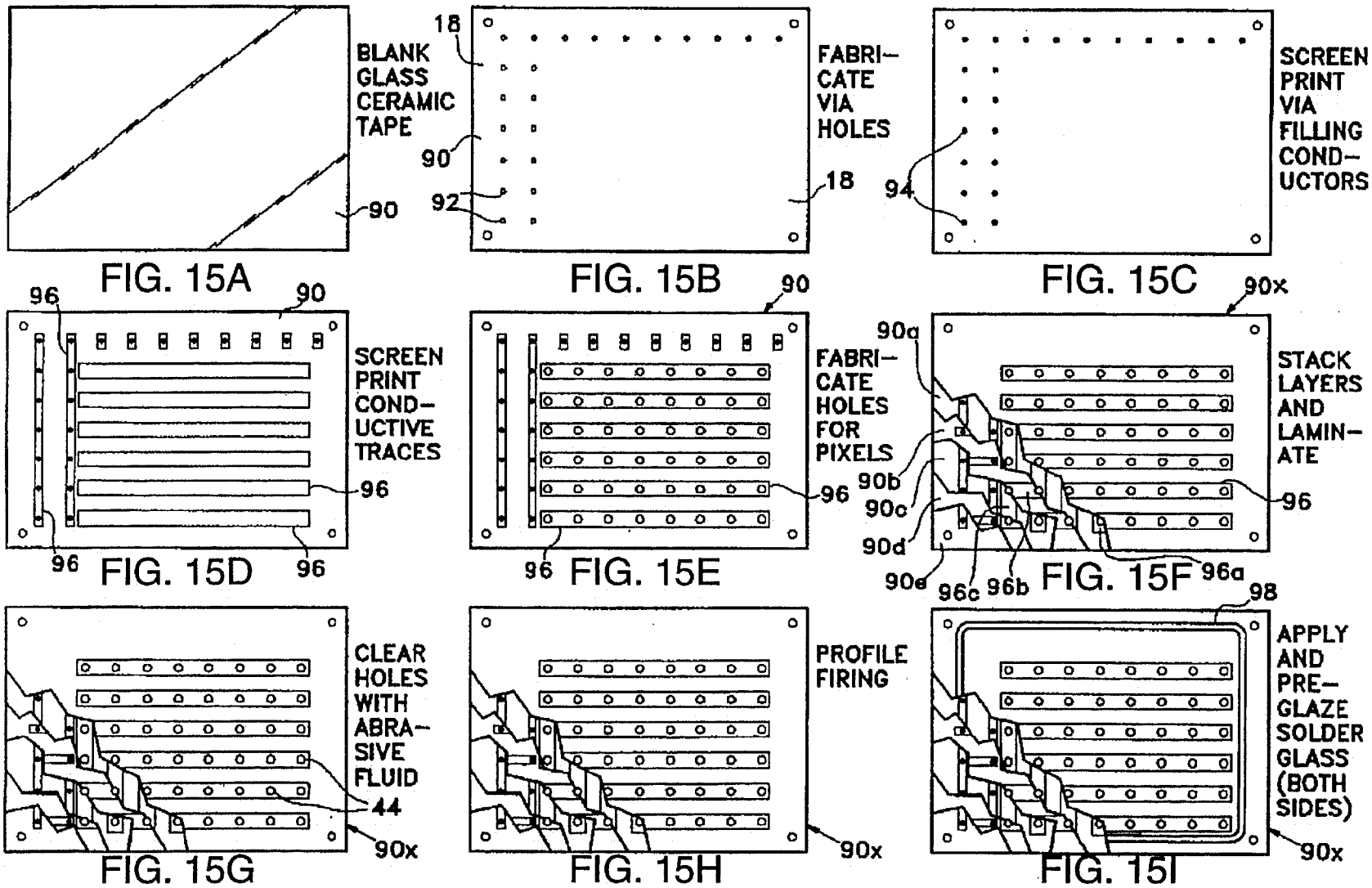
FIGS. 15A through 15X (sometimes together referred to as FIG. 15) collectively show steps in a sequence of formation and assembly of the components which form a flat screen CRT assembly according to the invention.
Figure 15L:
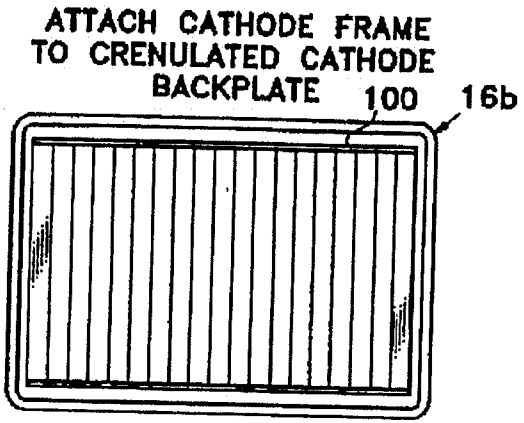
Figure 15N:
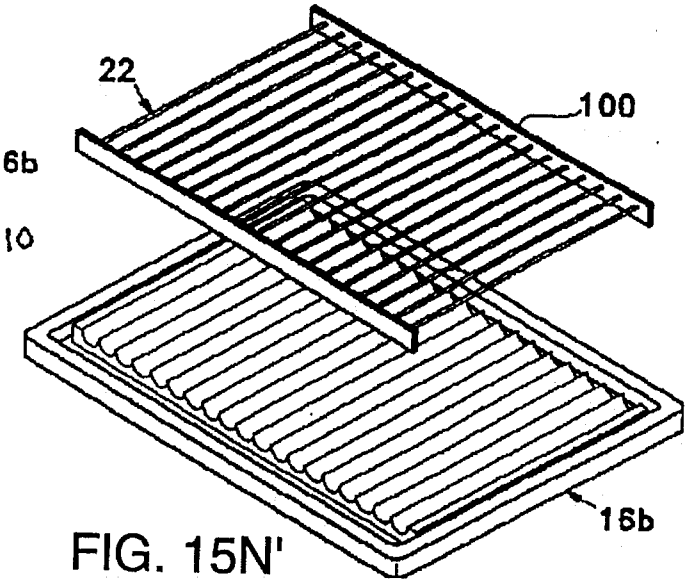
Figure 15K:
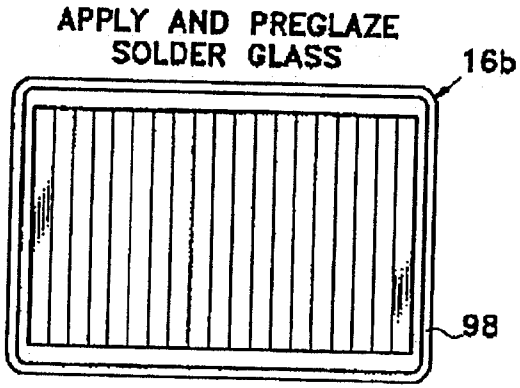
Figure 15N:
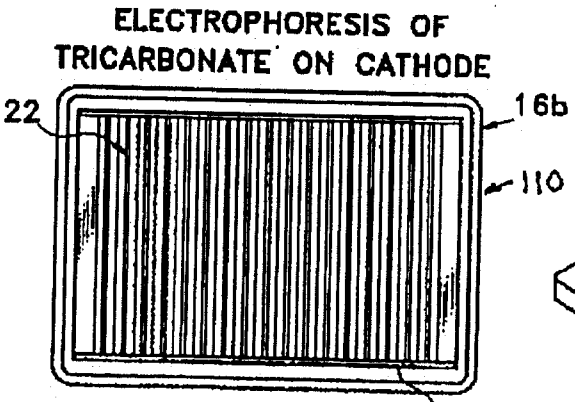
Figure 15J:
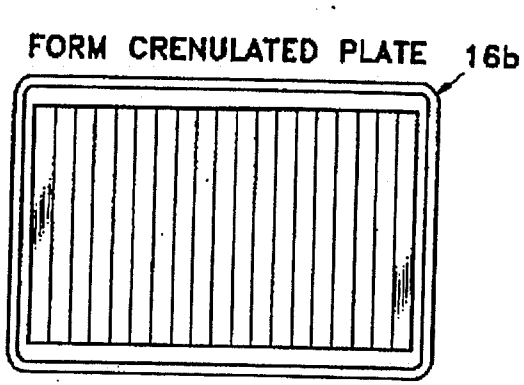
Figure 15M:
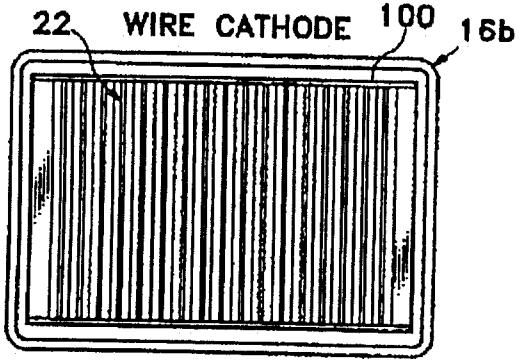
Figure 15R:
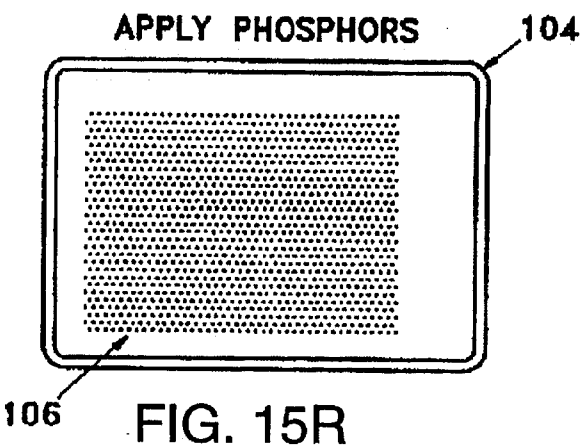
Figure 15Q:
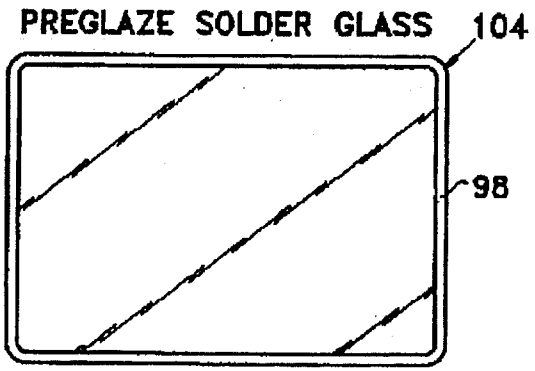
Figure 15P:
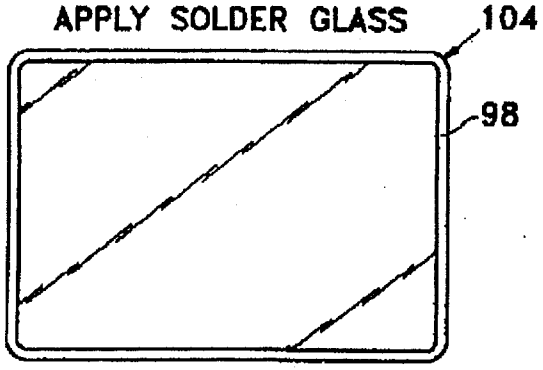
Figure 15S:
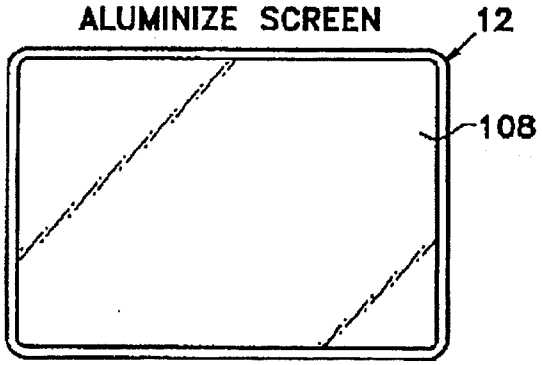
Figures 15T, 15U, 15V, 15W, 15X:
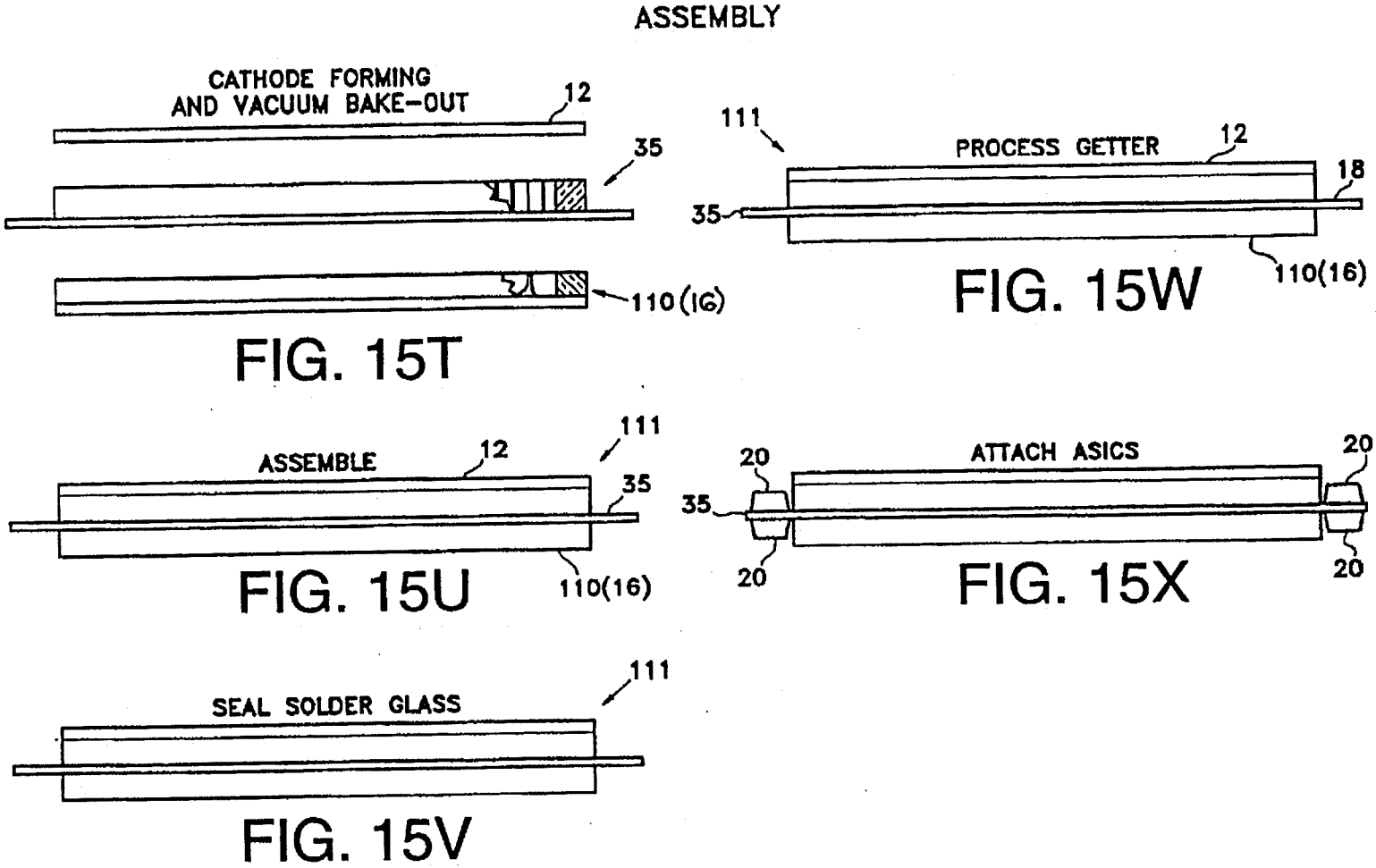

FIG. 15, comprising FIGS. 15A through 15X, gives a schematic illustration of the process and formation of the multilayer grid structure 35 and of the cathode and anode and the ultimate assembly of these components.

Figure 16A:
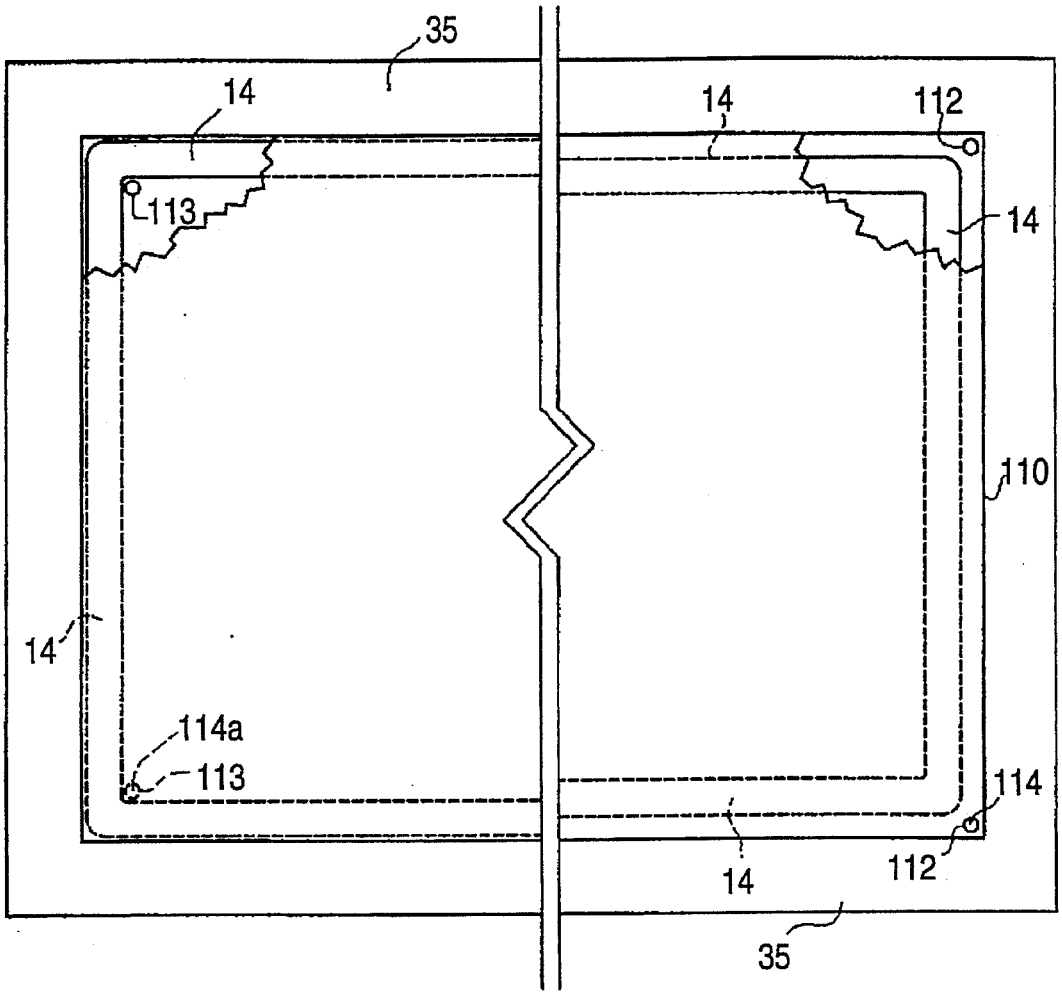
FIGS. 16A and 16B schematically indicate the use of pins for alignment and registry of the anode or face plate, the addressing grid and the back plate upon assembly of the flat screen CRT assembly.
Figure 16B:
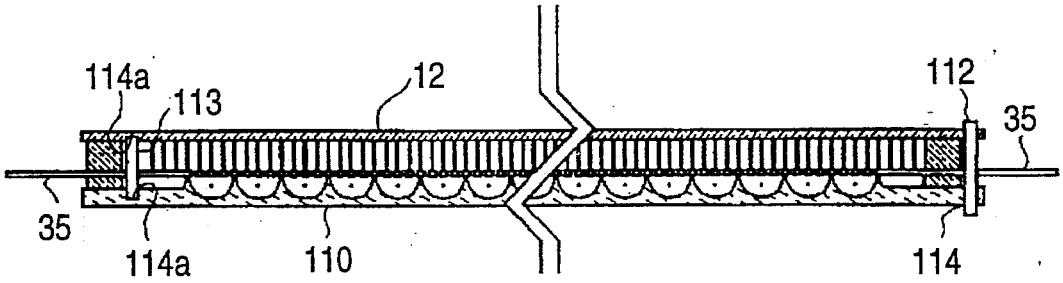

FIG. 15A indicates one of the sheets of unfired blank glass-ceramic tape 90. In FIG. 15B the punching of via holes 92 is indicated through one or more layers of the glass-ceramic material 90, and this hole forming operation can be performed in accordance with a process of the invention described below with reference to FIG. 16. The via holes are distinguished from the electron addressing holes, which can be formed at a different stage. Via holes are formed in margin area 18 and may be formed between pixel holes so as to permit interconnection of traces between layers.

FIG. 15C indicates filling of the via holes with conductive material, forming conductive vias 94. In accordance with an embodiment of the invention, the via filling is accomplished by screen printing (or other types of printing) of the conductive material into the via holes, in the known manner used for multilayer ceramic circuits. This can be done, for example, using du Pont's 6141D via filling paste.

In FIG. 15D the depositing of the conductive traces 96 on one sheet 90 of glass-ceramic material is indicated. The trace material specified for du Pont Green type is 6142D. This can be accomplished by screen printing techniques or other types of printing. A drying step may follow wherein the layers are heated sufficiently to remove the volatiles from the inks of the conductive traces. The conductive traces 96 (which will lie in different directions on different sheets of the material) are positioned in paths where the pixel holes will be located. The conductive vias 94 may also have conductive traces deposited over them on some layers. As indicated, the conductive vias 94 are located in areas outside the viewing area, i.e. outside the area having the pixel holes (although in another embodiment described below, the vias are formed between and among the pixel addressing holes so as to leave the peripheral areas free for joining screen sections modularly).

For embodiments of the invention in which a ceramic tape produced by Coors Electronic Package Co. (or other high-fired ceramic) is used, the trace material is tungsten.

FIG. 15E indicates the step of forming the multiplicity of pixel holes 44 in the sheet 90 of unfired glass-ceramic material. As with the via holes 92 (FIG. 15B), this grid of very small holes may advantageously be formed in accordance with a hole-blowing process described below with reference to FIG. 16.

In an alternative embodiment, via holes 92 are formed by laser drilling.

In FIG. 15F the series of layers 90 including layers 90*a*, 90*b*, 90*c*, 90*d*, 90*e* have been stacked and laminated together. The pixel holes 44 have been formed identically in each layer, so that they are in good registry in the resulting stack 90*x*. Lamination may be accomplished at this stage by a low temperature heat application, such as at about 70° C. between hot platens, with pressure of about 1000 to 2000 psi. This low heat is sufficient to fuse the plasticizers together between layers, so that the layers are bound together by the plasticizers. FIG. 15F indicates conductive traces 96 running in the horizontal direction. Other traces 96*a*, 96*b*, 96*c* are indicated below, by successively cutaway layers at the lower left.

Figure 17:
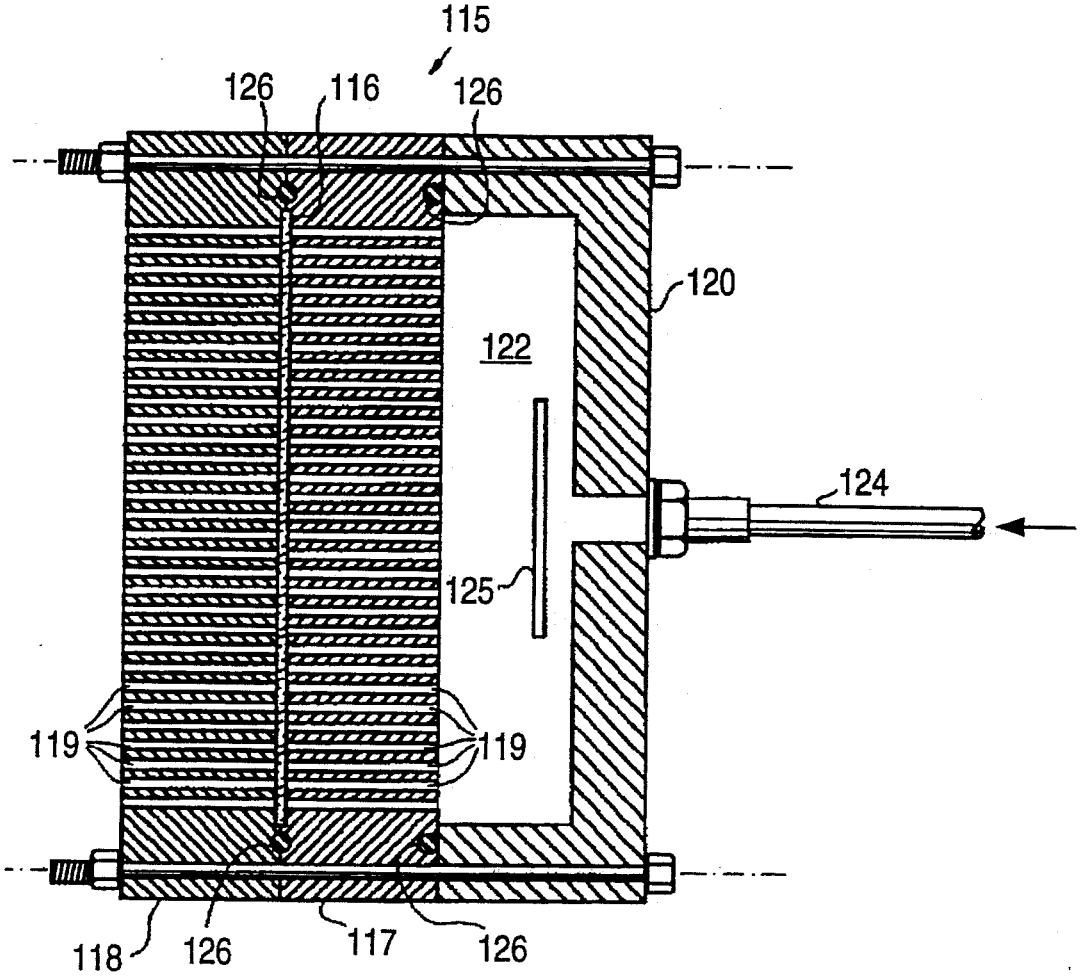
FIG. 17 is a sectional view illustrating a device for forming holes in unfired glass-ceramic sheets by use of fluid pressure through a die.

FIG. 15G represents another step according to a specific embodiment of the invention, whereby the multiplicity of holes 44, laid together in registry in the laminated stack of layers 90*x*, are treated with a flow-through of abrasive-containing fluid, preferably liquid (for example, water containing silicon carbide sub-mil particles). This operation is conducted with a pair of opposed die plates supporting the laminated structure as explained below with reference to FIG. 17. The pumping of abrasive-containing liquid through the pattern of holes, with the die plates on either side to channel the flow, effectively reams all the holes to be sure they are the correct size and shape as desired, correcting any minor irregularities in registry among the layers, which are still plastic and unfired. In addition, if mechanical punching was used to form the hole, any smear of the metal conductor trace material along the wall of the hole may advantageously be removed.

In FIG. 15H the laminated structure is fired, in a stepped or profile firing. This may be at an initial temperature of about 350° C. in which the organics are burned out, increased in a prescribed profiling mode up to about 950° C., depending on the materials.

As described above with reference to FIGS. 12, 13 and 14A in particular, the addressing grid must be supported at front and back (except for small screen embodiments), as by front supports 42 and back supports 51 engaged between the addressing grid structure 35 and the face plate 12 or the back plate 16, respectively.

In regard to spacing support between the addressing grid and the anode or face plate, a variety of techniques may be used. One method is to use a layer of photoreactive glass material which is much thicker than the addressing grid structure 35 (several layers may be used). The addressing grid 35 can be used as a mask for exposure of the photoreactive layers, with the UV light forming into a controlled diverging cone in the glass as projected through each grid hole. A thermal step may then be required to make the exposed volumes acid-etchable. The layer is then acid-etched to remove material at all areas except between addressing grid holes and therefore between pixel dots, where support is desired. The resulting spacer support is then thermally processed to enhance its strength.

Another method for forming the front side supports or spacers again involves use of the addressing grid structure as a photo mask. Unfired glass-ceramic tape can be used, in one thick layer or a series of stacked layers, the tape being formulated with a photolithographic characteristic. The photo sensitive glass-ceramic tape is translucent and nearly transparent, such that the appropriate reactive light (such as ultraviolet) can pass through the spacer layer (or a series of layers separately) in the plastic, unfired state. The light is passed through the unfired addressing grid structure (following the step of FIG. 15G, above) and into the spacer material. In this case the plastic binder in the glass-ceramic material changes by exposure to light, changing so as to allow it to be removed. Once exposed to the appropriate light, the disks or cone-shaped volumes within the plastic spacer material, unlike the remainder of the spacer material, can be removed by attacking the plastic binder material with an appropriate acid or solvent. The glass and/or ceramic particles wash away with the removal of the binder. After this operation, the unfired, plastic perforated spacer sheet (or sheets) can be put together with the glass-ceramic grid itself, and fired together as in the step of FIG. 15H.

Another procedure which can be used for the front spacers or spacer sheet is the earlier described process of blowing out holes through unfired glass-ceramic tape. As an example, five sheets of unfired tape, each approximately 0.030 inch thick, can be blown out by fluid pressure using an appropriate pair of dies as described above. Instead of forming an individual hole to correspond to each addressing grid hole, larger holes can be formed, such as for a triad of phosphor dots, i.e. one for each pixel of holes on the addressing grid. In this way the aspect ratio of material thickness to hole diameter or width can be maintained, for efficient formation of the holes with the fluid pressure process. As above, the openings in the spacer sheets can be cleaned out and reamed to the correct size and shape using an abrasive liquid pumped through the holes of the spacer sheet between the dies.

A still further procedure which can be used to form the front spacer structure again involves use of the addressing grid structure. In a procedure which uses some of the principles of a procedure for rapid prototyping, the perforated addressing grid structure may be placed at the surface of a pool of liquid, front surface down. The liquid is comprised of ultraviolet curable polymers, and its depth, i.e. the depth from the face of the addressing grid to the bottom of the pool, is the depth desired for the spacer sheet. Ultraviolet light is directed through the addressing grid holes and down into the liquid, in a manner to establish a controlled divergence of the light through the depth of the liquid. The liquid is not purely transmissive, helping to scatter the light into generally a cone shape. The result of the light exposure step is to cure the top surface of the liquid (in the event it extends slightly above the addressing grid), as well as through all of the desired hole locations and in the desired generally conical diverging shape beyond the holes. One advantage of the UV curable liquids (such as that manufactured by UVEXS, Inc. of Sunnyvale, Calif.), is that no volatiles are included in the liquid material, and thus the material does not dry on exposure to air.

With the desired regions cured, the addressing grid structure is removed from the liquid bath and inverted, thus establishing a mold which can be used to produce the desired spacer sheet. A castable glass-ceramic material, i.e. unfired glass-ceramic material formulated into a castable form, is vacuum cast on the surface of the addressing grid, to a depth extending to the tips of the fine, filament-like posts (each, for example, about 4–8 mils in diameter at its upper end). The cast material, which will become the spacer sheet, sets up and then can be put in the furnace with the addressing grid and fired together with the grid. The cast ceramic sheet cures and its binders are burned out, shrinking to the same extent as the addressing grid (unless non-shrink ceramics are used), and the plastic filaments or columns extending through and up from the addressing grid holes are burned out.

In additional embodiments of the invention, the holes in the spacer structure can be formed by laser drilling or mechanical punching.

After the stepped or profile firing step indicated in FIG. 15H (which may include firing of a spacer structure in combination with the grid), the amorphous glass in the glass-ceramic layers has fused together between layers, permanently bonding the layers into an integral, layered laminate with the conductive traces between layers and, if desired, also on one or both of the exposed front and back surfaces. If all of the conductive traces are below the surface, they are brought to the surface by the conductive vias 94, or in an alternate configuration not illustrated, the different layers can extend in stepped fashion laterally out from the seal, so that contacts associated with the conductive traces are exposed serially by layer in this way. However, the preferred embodiment is to bring all the leads to integrated circuits mounted as shown schematically in FIG. 12. This advantageously utilizes the properties for which cofired ceramic tape was developed (for example, those properties listed above) and eliminates the need and associated costs inherent with using connectors and mounting the drive circuits remote from the display.

FIG. 15I indicates the application of solder glass 98 (similar to an ink or paint) to the front and back surfaces in a peripheral rectangular pattern at the location of the seal area 14 shown in FIG. 12. After application, the solder glass is pre-glazed (as also indicated in FIG. 15I) by heating the laminated structure to a temperature high enough to burn off the binders and fuse the glass particles together, but low enough not to cause devitrification (for solder glass that devitrifies). This preglaze temperature is generally between 400° C. to 600° C. depending on the binder and solder glass used (see steps listed in Table I below for one embodiment). Preglazing ensures that the binders, including organics, are cleanly burned away before the tube is sealed. This is particularly important in a high internal structure surface area to internal vacuum volume tube such as described herein, to avoid contaminants. Without preglazing, tube contamination can occur in either air or vacuum final seal due to a lack of sufficient oxygen to completely burn away (oxidize) the binder.

Other sealing techniques involve laser welding of metal flanges or laser welding of glass-ceramic materials.

The addressing grid 90*x*, which may have integral supports as described above, will now be identified as the grid 35 as noted in other drawings.

FIGS. 15J through 15N indicate schematically the production of the cathode assembly, which will be assembled to the multilayer addressing grid and to the anode assembly. In these figures and this discussion it is assumed that a thermionic or "hot" cathode is used. However, the cathode may be a microthermionic cathode or an appropriate form of cold cathode (field emitter device, FED).

FIG. 15J indicates the formation of a crenulated back plate 16*b* which will support the cathode and which will become the back plate 16 of the assembly. The sheet 16*b* is rigid, for example, a glass plate or a ceramic plate which has been fired (although metal alloys can be used matching the thermal coefficient of the addressing grid).

The back plate 16*b* and its support against the addressing grid, with the cathode structure between, can be formed in several different ways. As one example, the back plate can be formed of the same green tape glass-ceramic material as the addressing grid as described above. In this case the supports for contact with the addressing grid can be formed into the surface of the green glass-ceramic material in a crenulated configuration, leaving troughs or rows of recesses within which thermionic cathode wires can be positioned, as shown in FIGS. 13 and 14A. Such forming of the green tape surface can be by molding or stamping techniques. It is important that the supports be precisely positioned and of controlled and narrow dimension, since each support will form a line (or series of columns) which must contact or come near to the addressing grid between addressing holes. One method for achieving such precision in cathode troughs and in supports produces a result which is generally illustrated in FIG. 13. By one procedure the back supports 80 are formed integrally in the front surface of the back plate 16, by molding of the unfired glass-ceramic material using an appropriately formed mold. The shape of the troughs is cylindrical, but in other embodiments may be made non-cylindrical.

As shown in FIG. 13, a single cathode wire 26 can extend longitudinally through each trough formed by this method. Spacing from trough to trough can be about 200 mils, and 16 addressing grid holes 44 can be adjacent to each cathode trough.

Alternative methods of forming the back plate supports 80 may be used, such as deposition of vacuum compatible materials on the back plate before or after firing, interposition of a vacuum compatible spacer web between the back plate and the addressing grid upon assembly, or other suitable techniques.

Another form of back plate can again be a glass-ceramic plate, but without supports, the supports being formed on the back surface of the addressing grid. In another arrangement the back plate can be a sheet of glass, and the supports can either be formed on the back surface of the addressing grid or deposited by a suitable process on the glass backed plate.

FIG. 15K indicates firing of the solder glass 98 on the sheet of material 16*b*, which may be at about 400° to 600° C. as above.

In FIG. 15L the attachment of a cathode frame 100 is indicated. The cathode frame can comprise a conductive metal strip at top and bottom to which all cathode wires are secured; one or both sides can have spring strips (not shown) to which the cathode wire ends are secured so as to maintain tension in the wires through thermal changes. The spring strips in one embodiment comprise chemical milled strips in a frame formed of a metal which will maintain its springy characteristic even at high temperature, for example Hastalloy B.

FIG. 15M shows a wire cathode 22, having been secured via the cathode frame 100.

To reduce the effects of the voltage drop along the cathode wires when the cathode wires run perpendicular to the rows (as in the described embodiment) the voltage applied to the cathode wires can vary in time so that the voltage of the cathode wire adjacent to the row being addressed is near ground potential.

To reduce the power required to operate the tube, the cathode wires can be run parallel to the rows and the voltage on each end of the wire brought to an appropriate value, e.g., ground, as needed during row addressing. This approach will require that the cathode supports be electrically isolated from each other so that the cathode voltage can be controlled in synchronization with the row addressing.

In FIG. 15N the cathode wires 22 are indicated as being coated with tricarbonate, a conventional procedure which may be accomplished by electrophoresis. Spraying is an alternative process. By this process, carbonates of several metals such as strontium, calcium and barium are coated onto a tungsten wire (which may be thoriated as in the known process). In a later bakeout step under vacuum, the carbonates deposited on the cathode filaments are converted to oxides and all binding material is removed, a process well known in the industry. These steps assure that the assembled tube will have a clean cathode. Alternatively, bicarbonate mixes also give acceptable performance later forming a useful and efficient oxide cathode. This completes the back plate/cathode assembly.

FIG. 15N' shows the frame 100 with the cathode 22 removed from the back plate 16*b*, in exploded view for clarity (not indicating order of assembly).

FIGS. 15P through 15S relate to production of the anode assembly. To a sheet of glass 104 is applied a rectangular band of solder glass 98.

In FIG. 15Q is indicated the firing of the solder glass 98 to a preglaze state.

FIG. 15R indicates the phosphor application process to the face plate 104. The phosphor dots, including discrete color dots for each pixel, can be applied to the glass in a manner generally used for conventional video tubes such as the "photo-tacky" process. Photo-tacky is a process wherein a layer of material becomes tacky for a limited time when exposed to light. The phosphor powder is dusted onto the material and only sticks where the material is tacky. Alternatively, a photolithographic process as used with conventional CRT's could be used. In lieu of R, G and B phosphor dots for each pixel, R, G and B phosphor stripes may be applied, in a known conventional manner. Use of a flat glass face plate allows the use of alternate methods such as offset printing to apply the phosphor material. The phosphor is generally indicated as 106 in FIG. 15R.

FIG. 15S indicates aluminizing of the anode, i.e. covering the phosphor with a thin layer of aluminum 108, to protect and maintain the integrity of the phosphor dots and to increase the tube brightness by redirecting some of the rear directed photons toward the viewer. With aluminization, electrons must have a threshold level of energy to pierce the aluminum and excite the phosphor. This completes production of the anode/face plate 12.

FIGS. 15T through 15X indicate steps in assembly of the three components together: the back plate/cathode assembly 110, the multilayer addressing grid structure 35 with an anode support structure, and the anode assembly 12. In one embodiment, the steps are carried out entirely in vacuum. FIG. 15T indicates bakeout of the three components under vacuum, and FIG. 15U shows the lamination/assembly of the three components together, producing an assembly 111. The tube can be baked out unassembled because the high internal structure surface area as compared to internal tube volume may make conventional tubulation pumpout impractically long in production.

In FIG. 15V the assembly is heated to the extent that the solder glass seals soften and fuse together, typically at 450° C. for certain types of solder glass, and at times as prescribed in the material specification. Solder glass preglazing and sealing temperatures and times are generally specified by the glass manufacturer or are determined by the user using techniques known to those skilled in the art. Table I below gives an example for one embodiment.

FIG. 15W indicates one or more getters being processed. For example, if a flashed getter is used, a thin film or strip of metal (having an affinity for oxygen) is heated by electrical resistance and plated against appropriate surfaces inside the tube, such as in one or more peripheral areas of the glass-ceramic grid plate, outside the active addressing area. Active getters can also be used, wherein the getters act as vacuum ion pumps, active whenever the tube is powered.

Finally, FIG. 15X indicates connection of the ASIC drivers 20 to the finished addressing grid structure 35, which extends outwardly from the cathode/back plate assembly 110 (16) and the anode assembly 12. This involves making electrical contact between the ASIC drivers 20 and the conductive traces, vias or busses extending along the surfaces of the peripheral areas 18 of the addressing grid structure 35.

Although FIGS. 15A–15X illustrate one embodiment, alternative embodiments both laminate and fire the addressing grid before forming the addressing holes (as distinguished from the via holes). Holes can then be formed by laser, fluid pressure drilling, abrasive water jet, or other drilling process.

The following table outlines the processes depicted in FIGS. 15A through 15X and gives illustrative times, temperatures and materials for certain of the fabrication steps outlined in those figures. Most of these steps are described elsewhere in the specification in conjunction with the description of the relevant figure.

TABLE I

| FIG. NO. | Step Description | Process and Materials |
|---|---|---|
| | | Grid Assembly |
| 15A | Blank Tape for Grid | Blank Ceramic tape per material specification. |
| 15B | Via Holes | Form via holes per hole blowing technique described herein or per material specification. |
| 15C | Fill Via Holes | Print (screen or other technique) via filling paste in via holes, per material specifications. |
| 15D | Conductive Traces | Print conductive traces, per material specifications. |
| 15E | Holes for Pixels | Form holes for pixels (see description of FIG. 9). |
| 15F | Laminate Stacked Green Tape Layers | 70° C. @ 3000–4000 psi for 10 minutes, (rotate part 180° half way through lamination). |
| 15G | Clear Holes with Abrasive Fluid | Pump Water with 1 um SiC particles in suspension at 200 psi until clear (1–2 minutes). |
| 15H | Profile (Step) Firing | Firing schedule for 7 layer 2" test samples<br>1. Room temperature (RT) to 350° C. at 10° C./min.<br>2. 350° C. for 55 min. (binder burnout)<br>3. 350° C. to 860° C. at 10° C./min.<br>4. 860° C. for 13.0 min.<br>5. 860° C. to 840° C. at 10° C./min.<br>Note: Total time above 840° C. must not exceed 18 min. per material specification.<br>6. 840° C. to 500° C. at 6.5° C./min.<br>7. 500° C. to RT at 6.5° C./min. or less.<br>All temperatures are ±5° C., all ramps are ±10%.<br>Firing schedule for larger parts will differ from the above schedule as follows:<br>Larger and thicker parts need slower ramp up times and longer binder burn-out times (these times must be determined for each specific part). |
| 15I | Apply Solder Glass | 1. Screen print X-1175 (Owens-NEG) solder glass (–325 mesh) onto parts to be joined; anode, grid (both sides), and cathode.<br>2. Dry at 100° C. with IR lamp for 30 min.<br>3. Repeat process until a .004 in layer is built up. |
| 15I | Pre-glaze Solder Glass | 1. Place part on grate of traveling grate furnace or batch air oven and raise to |

TABLE I-continued

| FIG. NO. | Step Description | Process and Materials |
|---|---|---|
| | | 350° C. at 5° C./min.<br>2. 350° C. for 30 min. (Binder burnout).<br>3. 350° C. to 500° C. at 5° C./min.<br>4. 500° C. for 10 min. (To remove bubbles from the glazed part.<br>Repeat as necessary to eliminate all bubbles visible under 10× microscope).<br>5. Repeat step 4 under vacuum to remove all dissolved gases. |
| | | Cathode Assembly |
| 15J | Cathode Back Plate | Form crenulated cathode back plate by casting, molding, stamping or machining. |
| 15K | Apply, Pre-glaze Solder Glass | (See 7I, above). |
| 15L | Cathode Frame | Attach cathode frame to cathode back plate. |
| 15M | Wire Cathode | Attach cathode wires to cathode frame. |
| 15N | Tricarbonate on Cathode | Electrophoresis (or other deposition) of tricarbonate or bicarbonate onto cathode wires. |
| | | Anode Assembly |
| 15P | Apply Solder Glass | Apply solder glass to seal area on face plate (See 7I, above). |
| 15Q | Pre-glaze Solder Glass | (See 7I, above). |
| 15R | Apply Phosphors | Deposit (by screen printing, or other photolithographic technique) phosphors for pixel dots on anode side of face plate. |
| 15S | Aluminize Screen | Cover phosphor with thin layer of aluminum. |
| | | Assembly |
| 15T | Jig Assemble | Assemble cathode, grid, anode, and anode support structure with suitable jigs, fixtures, holding parts to be joined apart. |
| 15T | Form Cathode | 1. Place part in a vacuum furnace.<br>2. Pump vacuum station to $5 \times 10^{-7}$ T.<br>3. RT to 300° C. at 5° C./min.<br>4. Apply 1/10 of cathode operating voltage in step fashion. Allow the vacuum pressure to stabilize for 2 min. before advancing to the next voltage step.<br>5. At .6 of the cathode operating voltage hold for 10 min. until color stabilizes.<br>6. Advance voltage in steps of 1/10 of cathode operating voltage up to the cathode operating voltage.<br>Allow the color and vacuum to stabilize before advancing to the next voltage step.<br>7. Turn off power to cathode. |
| 15T | Vacuum Bake-Out | 1. Outgas tube at 300° C. until pressure stabilized at $1 \times 10^{-6}$ T.<br>2. Continue to outgas for 1 hour. |

TABLE I-continued

| FIG. NO. | Step Description | Process and Materials |
|---|---|---|
| 15U | Assemble Tube | Bring together the cathode/back plate assembly, the addressing grid and the anode/face plate for joining. |
| 15V | Seal Solder Glass | 1. 300° C. to 475° C. at 5° C./min.<br>2. 475° C. for 15 min.<br>3. 475° C. to 300° C. at 5° C./min.<br>4. 300° C. for 15 min. (annealing)<br>5. 300° C. to RT at 5° C./min. |
| 15W | Process Getter | Process flash getter by application of prescribed voltage. |
| 15X | Attach ASICs | Connect ASIC drivers to completed grid structure, with electrical contact to conductive traces, vias and busses. |

Shrinkage uniformity is important in producing an addressing structure and in producing an assembled CRT which is accurate and functions properly. In particular, the positions of the pixel holes must be sufficiently predictable and accurate that each hole will be in registry with and will address the appropriate phosphor dot. Most ceramic tapes exhibit some nonuniformity in shrinkage, but glass-ceramic tape systems have been developed having high z shrinkage and zero x-y shrinkage. Material such as du Pont 851U Green Tape has a shrinkage of 12% in x and y and 17% in z. If pressure is applied in z during firing then the x-y shrinkage can be reduced to zero while increasing the z shrinkage. Shrinkage uniformity is the variation of the shrinkage from nominal shrinkage during the firing process. Shrinkage uniformity is defined as the change or variation in shrinkage from the nominal value. Thus 0.2% shrinkage uniformity about a nominal 12% shrinkage would result in the part shrinking to anywhere from 87.8% to 88.2% of its original size. Thus two holes 10 inches apart in the unfired state could be located anywhere from 8.820 inches to 8.780 inches apart after firing. For 0.01% shrinkage uniformity the range for the same example would be 8.801 inches to 8.799 inches. In high shrinkage material, such as du Pont 851U, the nominal shrinkage uniformity is 0.2%. For certain display applications such as VGA or SGVA variations of this amount would not allow the grid pixel holes to align with independently formed phosphor dots. The preferred embodiment is to reduce the shrinkage to thereby reduce the shrinkage variation. The desired shrinkage uniformity is 0.04% for VGA level resolution and 0.025% for SGVA resolution. By reducing the shrinkage to near zero, the shrinkage uniformity can be improved, using materials that utilize compression during firing to control shrinkage. For higher resolutions than can be maintained with available materials or processes each grid can be used as its own mask for photo-lithographic application of the phosphor dots, thereby eliminating any misalignment between the individual pixel holes in the grid and the corresponding phosphor dot.

It is also pointed out that the invention permits non-rectangular screen shapes and irregular screen shapes, since the CRT assembly is self-supporting and no electron gun is involved. A screen can be circular, for example, as in a radar screen, or irregular so as to fit into a vehicle dashboard or an aircraft control panel. Grids need not have addressing holes laid out on an orthogonal basis, but can be arranged by polar coordinates. In a circular screen, for example, holes can be on radial lines, with traces following radial lines and others in concentric circles.

Certain terms are used in the above description and should be interpreted broadly. The term "hole" is intended to encompass not only circular holes, but also slot-shaped holes, elliptical holes, hexagonal holes, triangular holes, or any other shape which might be appropriate for a particular application or selected arrangement of the addressing grid and the pixels. Differently shaped holes are appropriate to different types of screens and also to the number of colors selected in a color complement for a pixel. If four-color pixels are selected, square-shaped or diamond-shaped holes may be preferred.

Also, the term "plastic" is sometimes used herein in its technical sense of meaning workable or deformable in a nonelastic way.

Throughout this description, the term "display" is used. However, the invention includes other applications that may not necessarily involve viewing the device. For example, the invention may be useful for spatially or temporally addressing another device with light or as a component in a printer.

Various embodiments of the invention have been described. The descriptions are intended to be illustrative, not limitative. Thus, it will be apparent to one skilled in the art that certain modifications may be made to the invention as described without departing from the scope of the claims set out below.

We claim:

1. A flat panel device comprising:

a faceplate;

a backplate connected to the faceplate to form a sealed enclosure;

means for emitting light from the flat panel device; and a spacer situated within the enclosure and supporting the backplate and the faceplate against forces acting in a direction toward the enclosure, wherein the spacer is made of ceramic reinforced glass or metal coated with an electrically insulating layer.

2. A flat panel device as in claim 1, wherein the spacer comprises a spacer wall.

3. A flat panel device as in claim 2, further comprising at least one additional spacer wall situated within the enclosure.

4. A flat panel device as in claim 2, further comprising an addressing grid through which a plurality of addressing grid holes extend and wherein a surface of the spacer wall is located adjacent the addressing grid such that the surface lies between the addressing grid holes.

5. A flat panel device as in claim 4, further comprising a plurality of additional spacer walls situated within the enclosure.

6. A flat panel device as in claim 5, wherein:

the addressing grid holes or groups of the addressing grid holes are formed in rows; and two or more of the rows of the addressing grid holes or groups of the addressing grid holes lie between each pair of the spacer walls.

7. A flat panel device as in claim 1, wherein the means for emitting light comprises:

a thermionic cathode; and light-emissive material situated over the faceplate.

8. A flat panel device as in claim 1, wherein the means for emitting light comprises:

a field emitter cathode; and light-emissive material situated over the faceplate.

9. A flat panel device as in claim 1, wherein the faceplate and the backplate are curved.

10. A flat panel device, comprising:

a faceplate;

a backplate connected to the faceplate to form a sealed enclosure;

means for emitting light from the flat panel device; and a spacer structure situated within the enclosure and supporting the backplate and the faceplate against forces acting in a direction toward the enclosure, a plurality of spacer structure holes extending through the spacer structure.

11. A flat panel device as in claim 10, further comprising an addressing grid through which a plurality of addressing grid holes extend and wherein each of the spacer structure holes is aligned with at least one of the addressing grid holes.

12. A flat panel device as in claim 11, further comprising a spacer wall situated within the enclosure.

13. A flat panel device as in claim 11, wherein the spacer structure is located between the addressing grid and the faceplate.

14. A flat panel device as in claim 11, wherein the spacer structure is located between the addressing grid and the backplate.

15. A flat panel device as in claim 11, wherein the cross-sectional area of each of the spacer structure holes is greater than the cross-sectional area of each of the addressing grid holes.

16. A flat panel device as in claim 11, wherein the cross-sectional area of each of the spacer structure holes is greater than the area enclosing a group of the addressing grid holes.

17. A flat panel device as in claim 11, wherein the cross-sectional area of each spacer structure hole is substantially constant throughout that hole.

18. A flat panel device as in claim 11, wherein the cross-sectional area of each spacer structure hole is not substantially constant throughout that hole.

19. A flat panel device as in claim 17, wherein the cross-sectional area of each spacer structure hole increases gradually from a location adjacent the addressing grid to a location adjacent the faceplate.

20. A flat panel device as in claim 10, wherein the means for emitting light comprises:

a thermionic cathode; and light-emissive material situated over the faceplate.

21. A flat panel device as in claim 10, wherein the means for emitting light comprises:

a field emitter cathode; and light-emissive material situated over the faceplate.

22. A flat panel device as in claim 10, wherein the faceplate and the backplate are curved.

23. A flat panel device comprising:

a first faceplate;

a second faceplate connected to the first faceplate to form a sealed enclosure;

first light-emissive material situated over the first faceplate;

second light-emissive material situated over the second faceplate;

a cathode; and a spacer situated within the enclosure and supporting the first faceplate and the second faceplate against forces acting in a direction toward the enclosure.

24. A flat panel device as in claim 23, further comprising:

a first addressing grid through which a plurality of holes extend; and a second addressing grid through which a plurality of holes extend.

25. A flat panel device as in claim 24, wherein the spacer comprises:

a first plurality of spacer walls located between the first addressing grid and the first faceplate;

a second plurality of spacer walls located between the second addressing grid and the second faceplate; and a third plurality of spacer walls located between the first addressing grid and the second addressing grid.

26. A flat panel device as in claim 25, wherein the first plurality of spacer walls comprises matched spacer walls, each located generally opposite one of the third plurality of spacer walls, and unmatched spacer walls, each not located generally opposite any of the third plurality of spacer walls.

27. A flat panel device as in claim 25, wherein the second plurality of spacer walls comprises matched spacer walls, each located generally opposite one of the third plurality of spacer walls, and unmatched spacer walls, each not located generally opposite any of the third plurality of spacer walls.

28. A flat panel device as in claim 25, wherein the third plurality of spacer walls comprises matched spacer walls, each located generally opposite at least one of the first and second pluralities of spacer walls, and unmatched spacer walls, each not located generally opposite any of the first and second pluralities of spacer walls.

29. A flat panel device as in claim 24, wherein the spacer comprises:

a first spacer structure located between the first addressing grid and the first faceplate; and a second spacer structure located between the second addressing grid and the second faceplate.

30. A flat panel device as in claim 29, wherein the spacer further comprises a plurality of spacer walls located between the first addressing grid and the second addressing grid.

31. A flat panel device as in claim 24, wherein the cathode is a thermionic cathode.

32. A flat panel device as in claim 24, wherein the cathode is a field emitter cathode.

33. A flat panel device as in claim 23, wherein the spacer is made of ceramic, glass-ceramic, ceramic reinforced glass, devitrifying glass, or metal coated with an electrically insulating layer.

34. A flat panel device as in claim 23, further comprising side walls through which the second faceplate is connected to the first faceplate.

35. A flat panel device comprising:

a faceplate;

a backplate connected to the faceplate to form a sealed enclosure;

means for emitting light from the flat panel device;

an addressing grid situated between the faceplate and the backplate, a plurality of addressing grid holes extending through the addressing grid;

a first plurality of cathode spacer walls situated within the enclosure between the addressing grid and the backplate, each cathode spacer wall having a greater thickness adjacent the backplate than adjacent the addressing grid; and a second plurality of anode spacer walls situated within the enclosure between the addressing grid and the faceplate.

36. A flat panel device as in claim 35, wherein the cathode spacer walls comprise matched cathode spacer walls, each located generally opposite one of the anode spacer walls, and unmatched cathode spacer walls, each not located generally opposite any of the anode spacer walls.

37. A flat panel device as in claim 35, wherein the anode spacer walls comprise matched anode spacer walls, each located generally opposite one of the cathode spacer walls, and unmatched anode spacer walls, each not located generally opposite any of the cathode spacer walls.

38. A flat panel device as in claim 35, wherein each cathode spacer wall includes an alignment plate adjacent the addressing grid.

39. A flat panel device as in claim 35, wherein the means for emitting light comprises:

a thermionic cathode; and light-emissive material situated over the faceplate.

40. A flat panel device as in claim 35, wherein at least one of the cathode and anode spacer walls comprises multiple sheets of laminated material.

41. A flat panel device as in claim 35, wherein at least one of the cathode and anode spacer walls is made of ceramic, glass-ceramic, ceramic reinforced glass, devitrifying glass, or metal coated with an electrically insulating layer.

42. A flat panel device as in claim 35, further including side walls through which the faceplate is connected to the backplate.

43. A flat panel device comprising:

a faceplate;

a backplate connected to the faceplate to form a sealed enclosure;

means for emitting light from the flat panel device;

an addressing grid situated between the faceplate and the backplate, a plurality of addressing grid holes extending through the addressing grid; and a spacer wall situated within the enclosure between the addressing grid and a selected one of the faceplate and the backplate, the spacer wall having a surface that follows a non-straight path between the addressing grid holes.

44. A flat panel device as in claim 43, wherein the surface of the spacer wall zig-zags diagonally between at least two rows of the addressing grid holes.

45. A flat panel device as in claim 43, wherein the surface of the spacer wall zig-zags rectangularly between at least two rows of the addressing grid holes.

46. A flat panel device as in claim 43, wherein the surface of the spacer wall crosses at least one row of the addressing grid holes.

47. A flat panel device as in claim 43, wherein the surface of the spacer wall follows a serpentine path between at least two rows of the addressing grid holes.

48. A flat panel device as in claim 43, wherein the surface of the spacer wall does not cross any rows of the addressing grid holes.

49. A flat panel device as in claim 43, further comprising at least one additional spacer wall situated between the addressing grid and the selected one of the faceplate and the backplate, each additional spacer wall having a surface that follows a non-straight path between the addressing grid holes.

50. A flat panel device as in claim 43, wherein the selected one of the faceplate and the backplate is the faceplate.

51. A flat panel device as in claim 43, wherein the means for emitting light comprises:

a thermionic cathode; and light-emissive material situated over the faceplate.

52. A flat panel device as in claim 43, wherein the means for emitting light comprises:

a field emitter cathode; and light-emissive material situated over the faceplate.

53. A flat panel device as in claim 43, wherein the spacer wall is made of ceramic, glass-ceramic, ceramic reinforced glass, devitrifying glass, or metal coated with an electrically insulating layer.

54. A flat panel device as in claim 43, wherein the spacer wall comprises-multiple sheets of laminated material.

55. A flat panel device as in claim 43, further including side walls through which the faceplate is connected to the backplate.

56. A flat panel device comprising:

a faceplate;

a backplate connected to the faceplate to form a sealed enclosure;

means for emitting light from the flat panel device; and a spacer wall situated within the enclosure and supporting the backplate and the faceplate against forces acting in a direction toward the enclosure, the spacer wall having a surface that follows a non-straight path adjacent the faceplate.

57. A flat panel device as in claim 56, wherein the surface of the spacer Wall follows a serpentine path adjacent the faceplate.

58. A flat panel device as in claim 56, wherein the surface of the spacer wall follows a diagonal zig-zag path adjacent the faceplate.

59. A flat panel device as in claim 56, wherein the surface of the spacer wall follows a rectangular zig-zag path adjacent the faceplate.

60. A flat panel device as in claim 56, wherein the means for emitting light comprises:

a thermionic cathode; and light-emissive material situated over the faceplate.

61. A flat panel device as in claim 56, wherein the means for emitting light comprises:

a field emitter cathode; and light-emissive material situated over the faceplate.

62. A flat panel device as in claim 56, further comprising at least one additional spacer wall situated within the enclosure and supporting the backplate and the faceplate against forces acting in a direction acting toward the enclosure, each additional spacer wall having a surface that follows a non-straight path adjacent the faceplate.

63. A flat panel device as in claim 56, wherein the spacer wall is made of ceramic, glass-ceramic, ceramic reinforced glass, devitrifying glass, or metal coated with an electrically insulating layer.

64. A flat panel device as in claim 56, wherein the spacer wall comprises multiple sheets of laminated material.

65. A flat panel device as in claim 56, further including side walls through which the faceplate is connected to the backplate.

66. A flat panel device comprising:

a faceplate;

a backplate connected to the faceplate to form a sealed enclosure;

means for emitting light from the flat panel device; and a spacer wall situated within the enclosure and supporting the backplate and the faceplate against forces acting in a direction toward the enclosure, wherein the spacer wall is made of ceramic, glass-ceramic, ceramic reinforced glass, devitrifying glass, or metal coated with an electrically insulating layer, the spacer wall comprising multiple sheets of laminated material.

67. A flat panel device as in claim 66, further comprising at least one additional spacer wall situated within the enclosure, each additional spacer wall comprising multiple sheets of laminated material.

68. A flat panel device as in claim 66, wherein the means for emitting light comprises:

a thermionic cathode; and light-emissive material situated over the faceplate.

69. A flat panel device as in claim 66 wherein the means for emitting light comprises:

a field emitter cathode; and light-emissive material situated over the faceplate.

70. A flat panel device as in claim 66, wherein the spacer wall has a surface that follows a non-straight path adjacent the faceplate.

71. A flat panel device as in claim 66, wherein the surface of the spacer wall follows a serpentine path adjacent the faceplate.

72. A flat panel device as in claim 66, further including an addressing grid situated between the faceplate and the backplate, a plurality of addressing grid holes extending through the addressing grid.

73. A flat panel device as in claim 66 wherein the faceplate and the backplate are curved.

74. A flat panel device as in claim 66 further including side walls through which the faceplate is connected to the backplate.

* * * * *